US009330616B2

(12) United States Patent
Horikawa et al.

(10) Patent No.: US 9,330,616 B2
(45) Date of Patent: May 3, 2016

(54) AUTOMATIC CORRECTION FUNCTION DETERMINING APPARATUS, NON-TRANSITORY COMPUTER READABLE MEDIUM, AND AUTOMATIC CORRECTION FUNCTION DETERMINING METHOD

(71) Applicant: FUJI XEROX CO., LTD., Tokyo (JP)

(72) Inventors: Kazuhiko Horikawa, Kanagawa (JP); Noriko Sakai, Kanagawa (JP); Toshihiro Iwafuchi, Kanagawa (JP)

(73) Assignee: FUJI XEROX CO., LTD., Tokyo (JP)

( * ) Notice: Subject to any disclaimer, the term of this patent is extended or adjusted under 35 U.S.C. 154(b) by 0 days.

(21) Appl. No.: 14/453,136

(22) Filed: Aug. 6, 2014

(65) Prior Publication Data

US 2015/0124002 A1 May 7, 2015

(30) Foreign Application Priority Data

Nov. 5, 2013 (JP) ..... 2013-229843

(51) Int. Cl.
*G09G 5/10* (2006.01)
*G09G 3/36* (2006.01)

(52) U.S. Cl.
CPC ..... *G09G 3/3607* (2013.01); *G09G 2320/0242* (2013.01); *G09G 2320/0276* (2013.01); *G09G 2320/0666* (2013.01); *G09G 2320/0693* (2013.01); *G09G 2340/06* (2013.01)

(58) Field of Classification Search
CPC . H04N 1/4078; H04N 1/6027; H04N 17/002; H04N 1/00015; H04N 1/00023; H04N 1/00031; H04N 1/00058; H04N 1/00063; H04N 1/00087; H04N 1/60; H04N 9/64; G06K 15/1878; G06K 15/027; G03G 2215/00063; G03G 15/5025; G09G 2320/0693; G09G 2320/0242; G09G 2340/06; G09G 2320/0276; G09G 2320/0666
See application file for complete search history.

(56) References Cited

U.S. PATENT DOCUMENTS

2007/0070214 A1* 3/2007 Nakamura ..... 348/222.1

FOREIGN PATENT DOCUMENTS

| | | |
|---|---|---|
| JP | A-6-95069 | 4/1994 |
| JP | A-2005-196108 | 7/2005 |
| JP | A-2007-65608 | 3/2007 |

* cited by examiner

*Primary Examiner* — Amare Mengistu
*Assistant Examiner* — Gloryvid Figueroa-Gibson
(74) *Attorney, Agent, or Firm* — Oliff PLC

(57) ABSTRACT

An automatic correction function determining apparatus includes an output unit and a determining unit. The output unit sequentially outputs a first display image and a second display image to a display. The first display image includes a target area being a colorimetric target and formed of a first image and a non-target area not being a colorimetric target and formed of a second image. The second display image includes the target area formed of the first image and the non-target area formed of a third image different in mean gradation value from the second image. The determining unit determines that an automatic correction function is active on the display, if a colorimetric measurement result of the target area in the first display image displayed on the display is different from a colorimetric measurement result of the target area in the second display image displayed on the display.

8 Claims, 19 Drawing Sheets

FIG. 7

| | | TEST IMAGE I | | | | | | | | |
|---|---|---|---|---|---|---|---|---|---|---|
| | | LUMINANCE TEST IMAGE I1 | | | HALFTONE TEST IMAGE I2 | | | SKIN COLOR TEST IMAGE I3 | | |
| | | I11 | I12 | I13 | I21 | I22 | I23 | I31 | I32 | I33 |
| BACKGROUND IMAGE Ia | R VALUE | 0 | 64 | 192 | 0 | 64 | 192 | 0 | 64 | 192 |
| | G VALUE | 0 | 64 | 192 | 0 | 64 | 192 | 0 | 64 | 192 |
| | B VALUE | 0 | 64 | 192 | 0 | 64 | 192 | 0 | 64 | 192 |
| | COLOR | BLACK | DARK GRAY | PALE GRAY | BLACK | DARK GRAY | PALE GRAY | BLACK | DARK GRAY | PALE GRAY |
| | AREA | Sa1 | Sa1 | Sa1 | Sa1 | Sa1 | Sa1 | Sa1 | Sa1 | Sa1 |
| FOREGROUND IMAGE Ib | R VALUE | 255 | 255 | 255 | 128 | 128 | 128 | 128 | 128 | 128 |
| | G VALUE | 255 | 255 | 255 | 128 | 128 | 128 | 0 | 0 | 0 |
| | B VALUE | 255 | 255 | 255 | 128 | 128 | 128 | 0 | 0 | 0 |
| | COLOR | WHITE | WHITE | WHITE | MEDIUM GRAY | MEDIUM GRAY | MEDIUM GRAY | MEDIUM RED | MEDIUM RED | MEDIUM RED |
| | AREA | Sb1 | Sb1 | Sb1 | Sb1 | Sb1 | Sb1 | Sb1 | Sb1 | Sb1 |

FIG. 12

| | | TEST IMAGE I | | | | | | | | |
|---|---|---|---|---|---|---|---|---|---|---|
| | | LUMINANCE TEST IMAGE I1 | | | HALFTONE TEST IMAGE I2 | | | SKIN COLOR TEST IMAGE I3 | | |
| | | I11 | I12 | I13 | I21 | I22 | I23 | I31 | I32 | I33 |
| BACKGROUND IMAGE Ia | R VALUE | 0 | 0 | 0 | 0 | 0 | 0 | 0 | 0 | 0 |
| | G VALUE | 0 | 0 | 0 | 0 | 0 | 0 | 0 | 0 | 0 |
| | B VALUE | 0 | 0 | 0 | 0 | 0 | 0 | 0 | 0 | 0 |
| | COLOR | BLACK | BLACK | BLACK | BLACK | BLACK | BLACK | BLACK | BLACK | BLACK |
| | AREA | Sa1 | Sa2 | Sa3 | Sa1 | Sa2 | Sa3 | Sa1 | Sa2 | Sa3 |
| FOREGROUND IMAGE Ib | R VALUE | 255 | 255 | 255 | 128 | 128 | 128 | 128 | 128 | 128 |
| | G VALUE | 255 | 255 | 255 | 128 | 128 | 128 | 0 | 0 | 0 |
| | B VALUE | 255 | 255 | 255 | 128 | 128 | 128 | 0 | 0 | 0 |
| | COLOR | WHITE | WHITE | WHITE | MEDIUM GRAY | MEDIUM GRAY | MEDIUM GRAY | MEDIUM RED | MEDIUM RED | MEDIUM RED |
| | AREA | Sb1 | Sb2 | Sb3 | Sb1 | Sb2 | Sb3 | Sb1 | Sb2 | Sb3 |

FIG. 18

| | | | LUMINANCE TEST IMAGE I1 | |
|---|---|---|---|---|
| | | | I11 | I12 |
| BACKGROUND IMAGE Ia | | R VALUE | 64 | 192 |
| | | G VALUE | 64 | 192 |
| | | B VALUE | 64 | 192 |
| | | COLOR | DARK GRAY | PALE GRAY |
| | | AREA | Sa4 | Sa4 |
| FOREGROUND IMAGE Ib | FIRST FOREGROUND IMAGE Ib1 | R VALUE | 255 | 255 |
| | | G VALUE | 255 | 255 |
| | | B VALUE | 255 | 255 |
| | | COLOR | WHITE | WHITE |
| | | AREA | Sb4 | Sb4 |
| | SECOND FOREGROUND IMAGE Ib2 | R VALUE | 0 | 0 |
| | | G VALUE | 0 | 0 |
| | | B VALUE | 0 | 0 |
| | | COLOR | BLACK | BLACK |
| | | AREA | Sb5 | Sb5 |

AUTOMATIC CORRECTION FUNCTION DETERMINING APPARATUS, NON-TRANSITORY COMPUTER READABLE MEDIUM, AND AUTOMATIC CORRECTION FUNCTION DETERMINING METHOD

CROSS-REFERENCE TO RELATED APPLICATIONS

This application is based on and claims priority under 35 USC 119 from Japanese Patent Application No. 2013-229843 filed Nov. 5, 2013.

BACKGROUND

Technical Field

The present invention relates to an automatic correction function determining apparatus, a non-transitory computer readable medium, and an automatic correction function determining method.

SUMMARY

According to an aspect of the invention, there is provided an automatic correction function determining apparatus including an output unit and a determining unit. The output unit sequentially outputs a first display image and a second display image to a display. The first display image includes a target area serving as a colorimetric target and formed of a first image and a non-target area not serving as a colorimetric target and formed of a second image. The second display image includes the target area formed of the first image and the non-target area formed of a third image different in mean gradation value from the second image. The determining unit determines that an automatic correction function is active on the display, if a colorimetric result obtained from colorimetric measurement of the target area in the first display image displayed on the display is different from a colorimetric result obtained from colorimetric measurement of the target area in the second display image displayed on the display.

BRIEF DESCRIPTION OF THE DRAWINGS

Exemplary embodiments of the present invention will be described in detail based on the following figures, wherein:

FIG. 7 is a diagram for illustrating the contents of a test image used in a first exemplary embodiment;

FIG. 12 a diagram for illustrating the contents of a test image used in a second exemplary embodiment;

FIG. 18 is a diagram for illustrating the contents of the test image in the third exemplary embodiment.

DETAILED DESCRIPTION

Exemplary embodiments of the present invention will be described in detail below with reference to the accompanying drawings.

First Exemplary Embodiment

Figure 1:
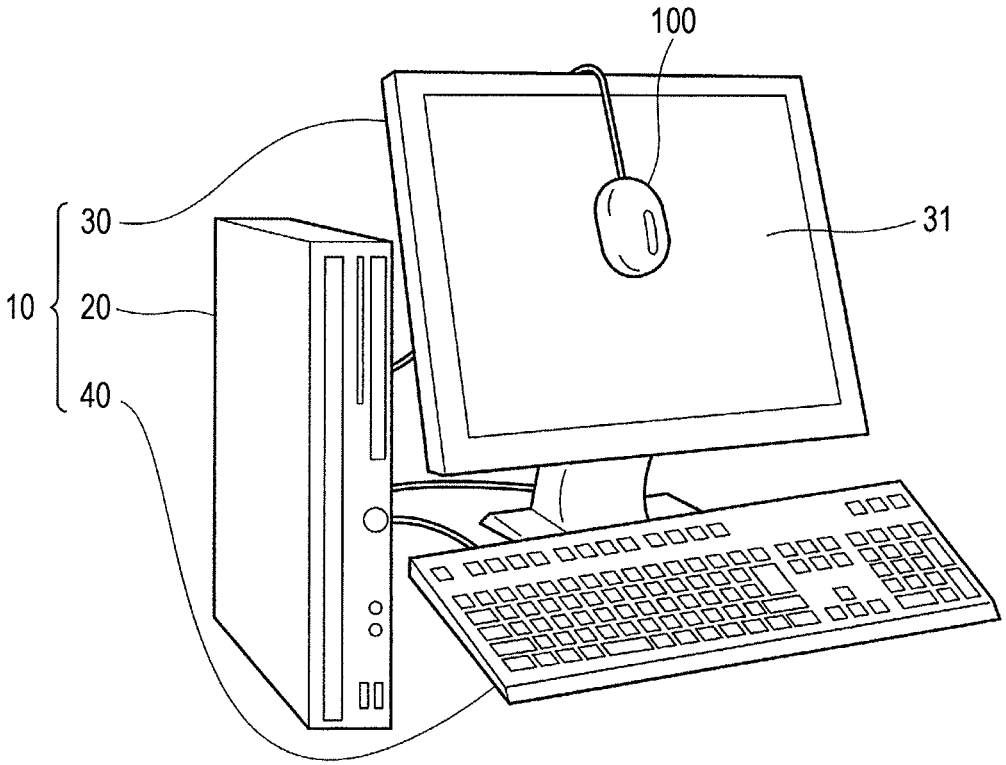
FIG. 1 is a diagram illustrating an example of the configuration of an image display system to which an exemplary embodiment of the present invention is applied.

FIG. 1 is a diagram illustrating an example of the configuration of an image display system 10 to which the present exemplary embodiment is applied.

The image display system 10 includes a computer 20 that performs, for example, creation of image data to be displayed, a display 30 that displays on a display screen 31 an image based on the image data created by the computer 20, and an input device 40 that receives, for example, an input to the computer 20.

In the image display system 10, the computer 20 and the display 30 are connected via a digital visual interface (DVI), and the computer 20 and the input device 40 are connected via a universal serial bus (USB). The computer 20 and the display 30 may be connected via a high-definition multimedia interface (HDMI; a registered trademark) or a DisplayPort in place of the DVI.

The computer 20 as an example of an automatic correction function determining apparatus is a so-called general-purpose personal computer. The computer 20 performs, for example, creation of image data by operating various types of application software under the control of an operating system (OS).

Further, the display 30 is a device having a function of displaying an image by additive color mixing, such as a liquid crystal display for a personal computer (PC), a liquid crystal television, or a projector, for example. Therefore, the display system of the display 30 is not limited to the liquid crystal system. Herein, it is assumed that the display 30 displays the image with three colors of red (R), green (G), and blue (B) in the present exemplary embodiment. FIG. 1 illustrates an example in which a liquid crystal display for a PC is used as the display 30, and thus the display screen 31 is provided in the display 30. However, if a projector is used as the display 30, for example, a screen or the like provided outside the display 30 serves as the display screen 31.

Further, the input device 40 may be a keyboard illustrated in FIG. 1 or a not-illustrated mouse, for example.

In the image display system 10, an image based on display image data (a display image) created by the use of the input device 40 and the computer 20, for example, is displayed on the display screen 31 of the display 30. Herein, when performing design or the like of a product by using application software operating on the computer 20, it is required to display the image on the display screen 31 of the display 30 with correct colors. The image display system 10 is therefore capable of executing a calibration operation of causing the display 30 to display on the display screen 31 a calibration image based on calibration image data created by the computer 20 and calibrating the colors to be displayed on the display screen 31 on the basis of a result of reading the calibration image displayed on the display screen 31.

Further, in the above-described calibration operation, the image display system 10 of the present exemplary embodiment executes, before displaying the calibration image on the display screen 31, an automatic correction function test for checking whether or not an automatic correction function is set in the display 30. Herein, the automatic correction function of the display 30 refers to a function of the display 30 to automatically correct the luminance, the gamma, a specific color (skin color, for example), and so forth of the image to be displayed on the display screen 31 on the basis of the contents of the image data input to the display 30. The function is not controllable by the computer 20, and is independently executed by the display 30. The display 30 may or may not have such an automatic correction function. Further, even if the display 30 has the automatic correction function, the automatic correction function may be set ON or OFF. In the automatic correction function test in the image display system 10, therefore, a test image based on test image data created by the computer 20 is displayed on the display screen 31 by the display 30, and whether or not the display 30 is displaying the image on the display screen 31 by using the automatic correction function is determined on the basis of a result of reading the test image displayed on the display screen 31.

If the calibration operation is executed with such an automatic correction function active on the display 30, an insufficient calibration result is obtained. Consequently, the image in correct colors fails to be displayed on the display screen 31.

In the following description, the calibration image displayed on the display screen 31 in the calibration operation and the test image displayed on the display screen 31 in the automatic correction function test will collectively be referred to as "colorimetric images."

Herein, FIG. 1 illustrates, together with the image display system 10, a colorimeter 100 used in the calibration operation including the above-described automatic correction function test to read the colorimetric image displayed on the display screen 31 of the display 30.

The colorimeter 100 includes a sensor (not illustrated) that reads the image in three colors of red (R), green (G), and blue (B). The colorimeter 100 is capable of measuring the colorimetric image displayed on the display screen 31 in so-called full-color. Further, in the example illustrated in FIG. 1, the colorimeter 100 hangs from an upper part of a casing of the display 30 being a liquid crystal display for a PC, and serves as a so-called contact type colorimeter including a light receiving surface that has a sensor and contacts with the display screen 31. Further, in this example, the colorimeter 100 and the computer 20 are connected via a USB. Further, the colorimeter 100 is disposed on the display screen 31 with a holder (not illustrated) for hanging the colorimeter 100. If a projector is used as the display 30, for example, the colorimeter 100 serves as a so-called non-contact type colorimeter that takes the colorimetric image projected on the screen by the projector from a position separated from the screen.

Further, in the present exemplary embodiment, the colorimeter 100 is configured to read a part of the entire display area of the display screen 31 corresponding to at most half the entire display area or smaller (hereinafter referred to as the colorimetric area).

Figure 2:
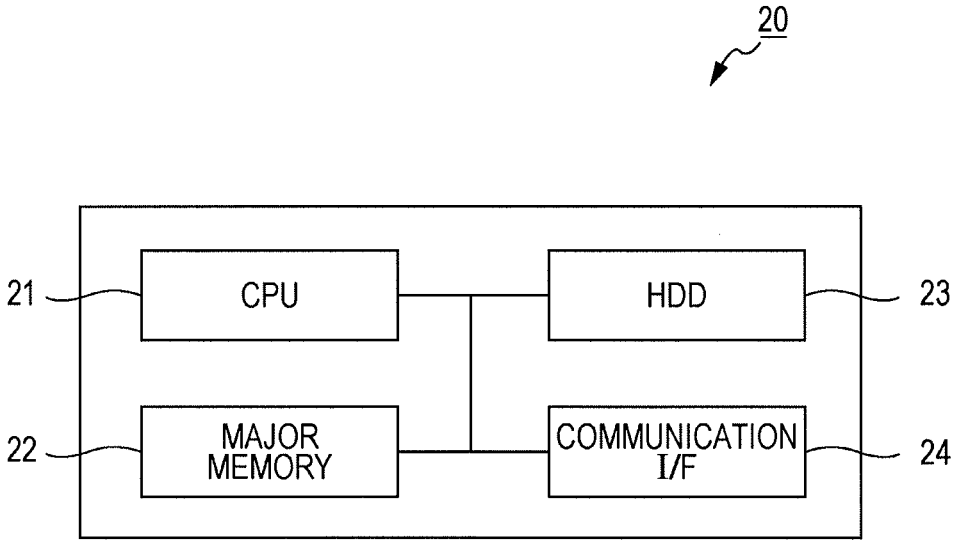
FIG. 2 is a diagram illustrating a hardware configuration of a computer.

FIG. 2 is a diagram illustrating a hardware configuration of the computer 20.

As described above, the computer 20 is realized by a personal computer or the like. Further, as illustrated in the drawing, the computer 20 includes a central processing unit (CPU) 21 serving as an arithmetic unit, a major memory 22 serving as a memory, and a hard disk drive (HDD) 23. Herein, the CPU 21 executes various programs such as an operating system (OS) and application software. Further, the major memory 22 serves as a storage area for storing, for example, the various programs and data for use in the execution thereof. The HDD 23 serves as a storage area for storing, for example, data input to and output from the various programs. The computer 20 further includes a communication interface (hereinafter described as "communication I/F") 24 for communicating with external devices including the input device 40 and the display 30.

Figure 3:
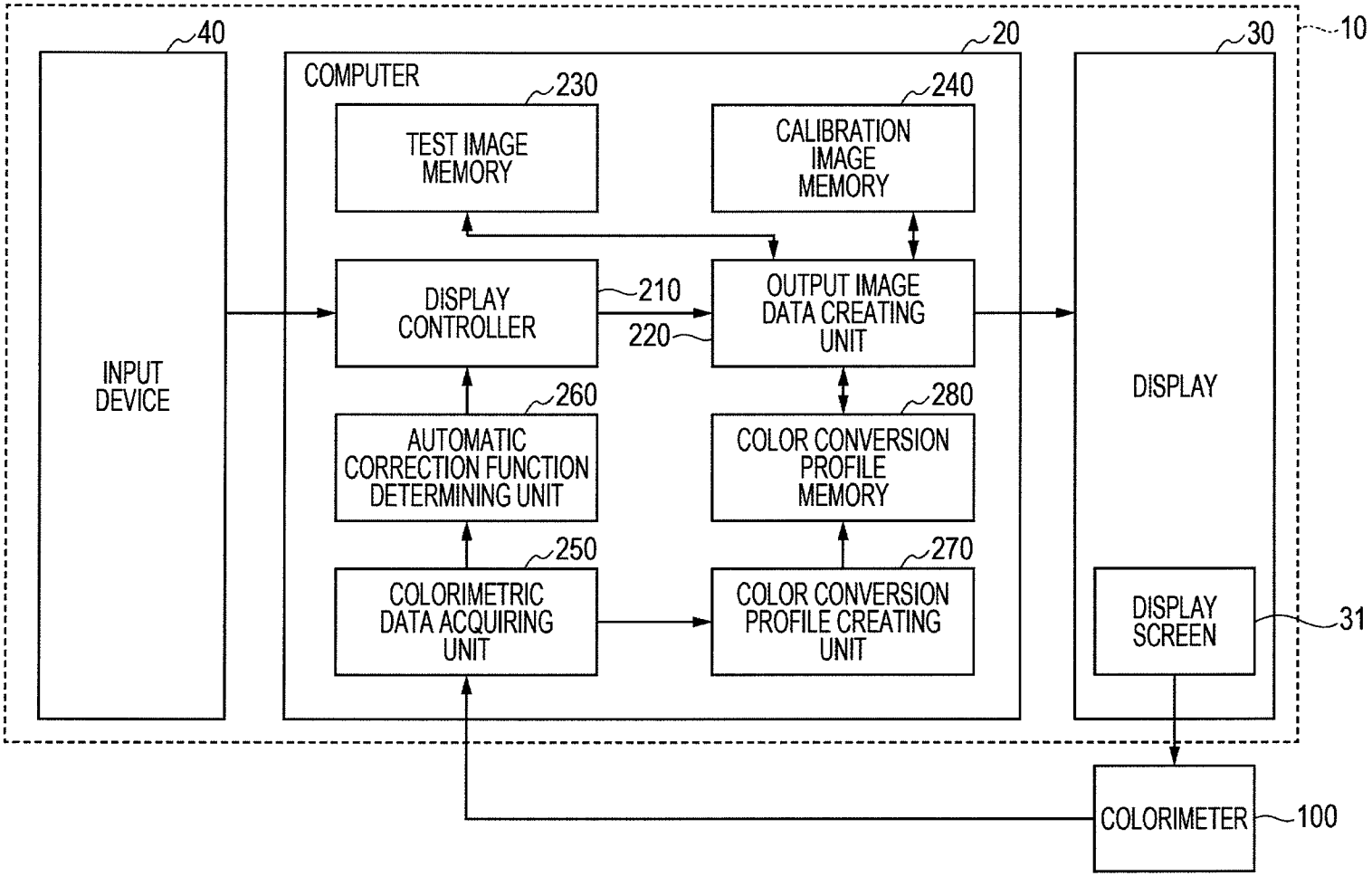
FIG. 3 is a diagram illustrating a functional configuration of the computer.

FIG. 3 is a diagram illustrating a functional configuration example of the computer 20 of the present exemplary embodiment.

The computer 20 includes a display controller 210, an output image data creating unit 220, a test image memory 230, a calibration image memory 240, a colorimetric data acquiring unit 250, an automatic correction function determining unit 260, a color conversion profile creating unit 270, and a color conversion profile memory 280.

The display controller 210 receives an instruction of a user input from the input device 40 and a determination result as to whether or not the automatic correction function is set, which is input from the automatic correction function determining unit 260. Further, the display controller 210 determines the type of the image to be displayed on the display screen 31 of the display 30 on the basis of the instruction and the determination result described above, and outputs a determination result obtained thereby to the output image data creating unit 220. Further, the display controller 210 controls the operations of the output image data creating unit 220, the test image memory 230, the calibration image memory 240, the colorimetric data acquiring unit 250, the automatic correction function determining unit 260, the color conversion profile creating unit 270, and the color conversion profile memory 280.

The output image data creating unit 220 as an example of an output unit receives the determination result as to the type of the image input from the display controller 210. Then, the output image data creating unit 220 creates output image data to be displayed on the display screen 31 of the display 30 on the basis of the above-described determination result, and outputs the created output image data to the display 30. Herein, the output image data created by the output image data creating unit 220 includes one of the display image data, the calibration image data, and the test image data described above.

The test image memory 230 stores the original data of the test image, which is used when the output image data creating unit 220 creates the output image data including the test image data.

The calibration image memory 240 stores the original data of the calibration image, which is used when the output image data creating unit 220 creates the output image data including the calibration image data.

The colorimetric data acquiring unit 250 acquires colorimetric data, which is the result of reading the colorimetric area by the colorimeter 100 in the colorimetric image (the test image or the calibration image) displayed on the display screen 31 of the display 30 on the basis of the output image data created by the output image data creating unit 220. Then, if the colorimetric data is test colorimetric data obtained by reading the test image, the colorimetric data acquiring unit 250 outputs the test colorimetric data to the automatic correction function determining unit 260. If the colorimetric data is calibration colorimetric data obtained by reading the calibration image, the colorimetric data acquiring unit 250 outputs the calibration colorimetric data to the color conversion profile creating unit 270.

The automatic correction function determining unit 260 as an example of a determining unit receives the test colorimetric data input from the colorimetric data acquiring unit 250. Then, the automatic correction function determining unit 260 determines whether or not the automatic correction function is set in the display 30 on the basis of the test colorimetric data, and outputs a determination result obtained thereby (the automatic correction function is set or is not set) to the display controller 210. Herein, the automatic correction function determining unit 260 of the present exemplary embodiment has a function of converting the color space (RGB color space) of the input test colorimetric data into the L*a*b* color space. However, the function of the automatic correction function determining unit 260 is not limited thereto, and may convert the RGB color space into the XYZ color space.

The color conversion profile creating unit 270 receives the calibration colorimetric data input from the colorimetric data acquiring unit 250. Then, the color conversion profile creating unit 270 creates a color conversion profile adapted to the display 30 on the basis of the calibration colorimetric data, and outputs the obtained color conversion profile to the color conversion profile memory 280.

The color conversion profile memory 280 stores the color conversion profile adapted to the display 30, which is input from the color conversion profile creating unit 270. Then, the color conversion profile memory 280 outputs the color conversion profile to the output image data creating unit 220 when the output image data creating unit 220 creates the output image data including the display image data.

Herein, when creating the output image data including the display image data, the output image data creating unit 220 of the present exemplary embodiment performs a color conversion process using the color conversion profile read from the color conversion profile memory 280. Meanwhile, when creating the output image data including the test image data or the output image data including the calibration image data, the output image data creating unit 220 does not perform the color conversion process using the above-described color conversion profile.

The functions of the display controller 210, the output image data creating unit 220, the test image memory 230, the calibration image memory 240, the colorimetric data acquiring unit 250, the automatic correction function determining unit 260, the color conversion profile creating unit 270, and the color conversion profile memory 280 forming the computer 20 illustrated in FIG. 3 are realized by the cooperation of software and hardware resources. That is, the CPU 21 provided in the computer 20 illustrated in FIG. 2 reads a program for realizing the functions of the respective units from a memory of the HDD 23 into the major memory 22, for example, to thereby realize the functions. Further, memories such as the HDD 23 and the major memory 22 realize the functions of the test image memory 230, the calibration image memory 240, and the color conversion profile memory 280.

Figure 4:
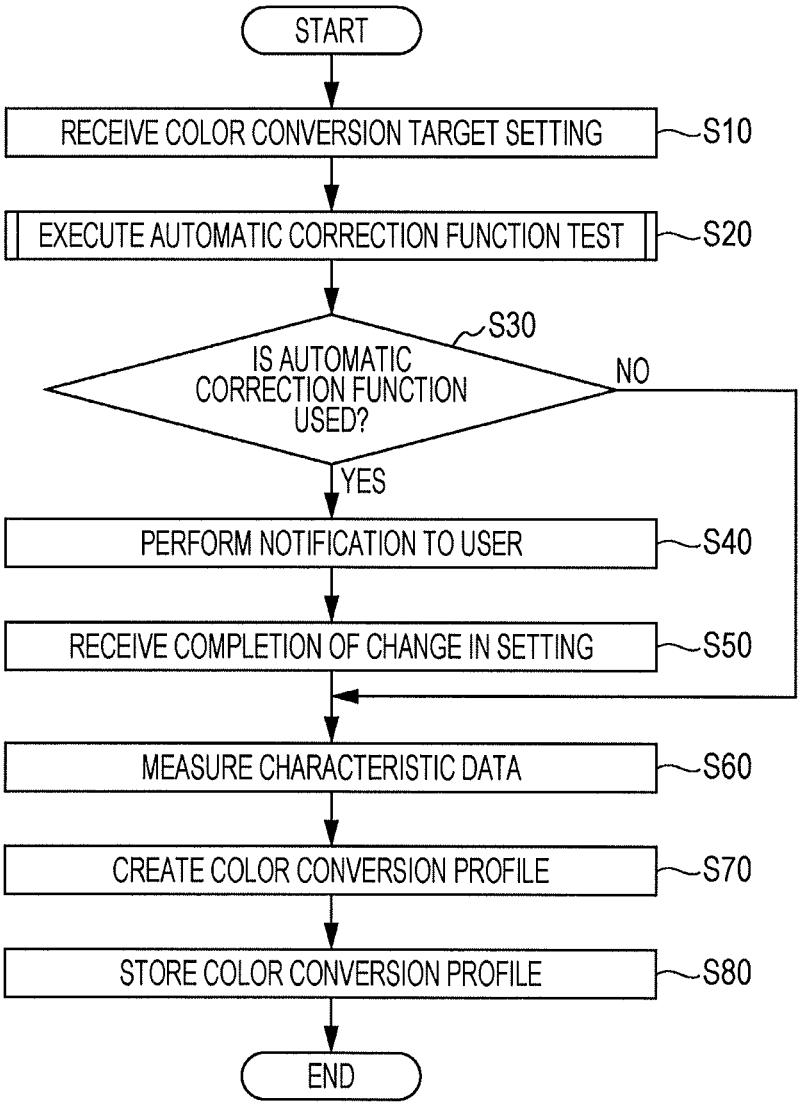
FIG. 4 is a flowchart illustrating a procedure of a calibration operation of a display.

FIG. 4 is a flowchart illustrating a procedure of the calibration operation of the display 30. The process described below is executed by the computer 20.

In this process, the display controller 210 first receives the setting of a color conversion target of the display 30 via the input device 40 (step S10). Then, upon receipt of the setting of the color conversion target, the display controller 210 executes the automatic correction function test for determining whether or not the display 30 is displaying the image on the display screen 31 by using the automatic correction function (step S20). At step S20, the automatic correction function test is executed with the output image data creating unit 220, the test image memory 230, the colorimetric data acquiring unit 250, and the automatic correction function determining unit 260. A specific procedure of the automatic correction function test will be described later.

Then, on the basis of a determination result of the automatic correction function test input from the automatic correction function determining unit 260, the display controller 210 determines whether or not the display 30 is using the automatic correction function in the current settings (step S30).

If a positive determination (YES) is made at step S30, the display controller 210 performs notification to the user to prompt the user to cancel the automatic correction function set in the display 30 (step S40). Herein, the notification to the user at step S40 may be performed by, for example, displaying a predetermined message on the display screen 31 of the display 30. If a negative determination (NO) is made at step S30, the display controller 210 proceeds to later-described step S60 to continue the process.

Then, upon receipt of completion of the change in setting of the display 30 (cancellation of the setting of the automatic correction function) via the input device 40 (step S50), the display controller 210 executes measurement of characteristic data for use in the creation of the color conversion profile for making a display characteristic of the display 30 match the color conversion target, the setting of which has been received at step S10 (step S60). At step S60, the display controller 210 executes the measurement of the characteristic data by causing the display 30 to display the calibration image and acquiring the calibration colorimetric data from colorimetric measurement of the displayed calibration image by the colorimeter 100 with the use of the output image data creating unit 220, the calibration image memory 240, and the colorimetric data acquiring unit 250. A specific procedure of the measurement of the characteristic data will be omitted.

Then, the color conversion profile creating unit 270 creates the color conversion profile for the display 30 on the basis of the characteristic data obtained at step S60 (step S70). The created color conversion profile is stored in the color conversion profile memory 280 (step S80), and the calibration operation is completed.

Figure 5A:
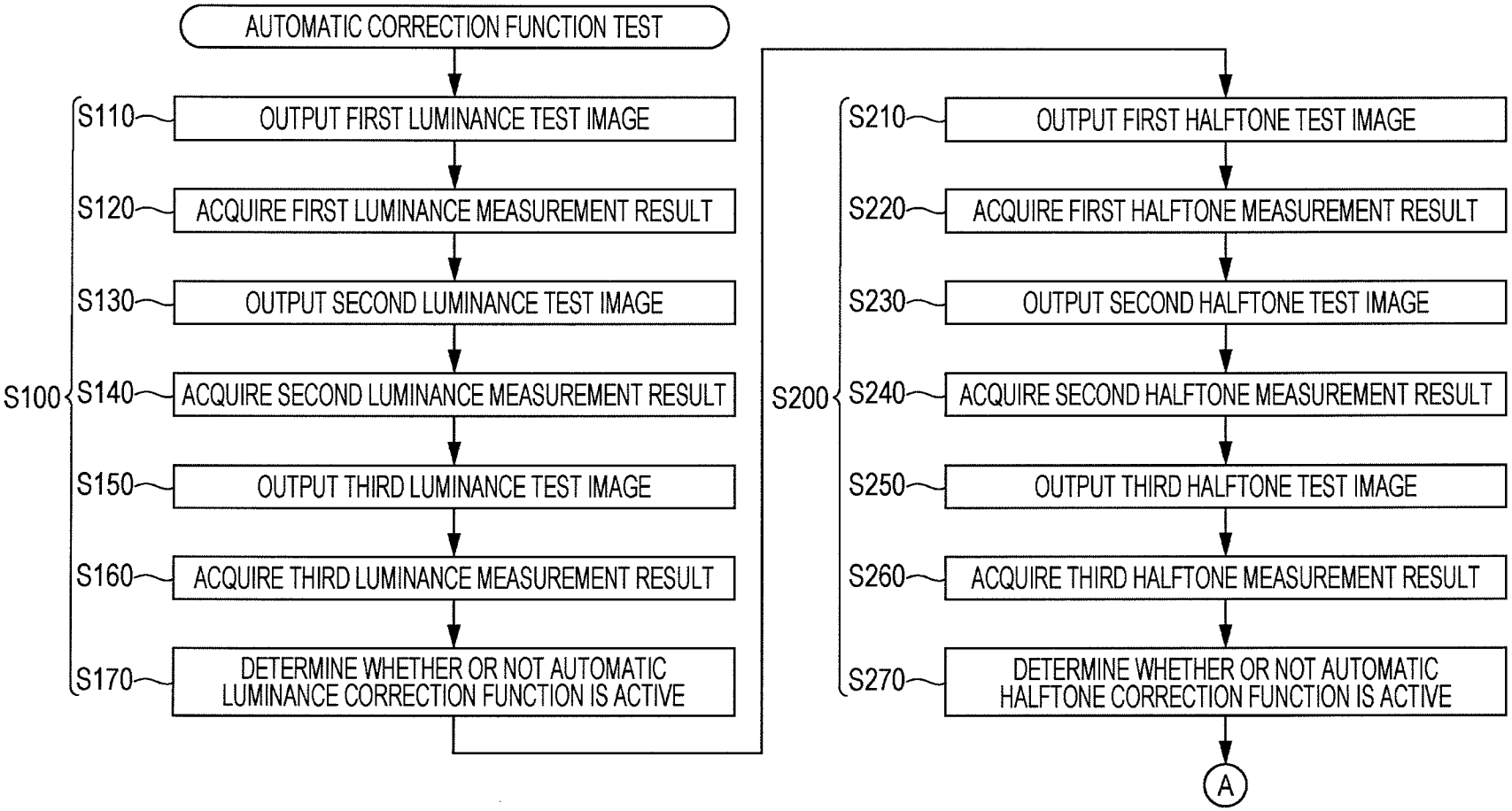
FIGS. 5A and 5B are a flowchart illustrating a procedure of an automatic correction function test.
Figure 5B:
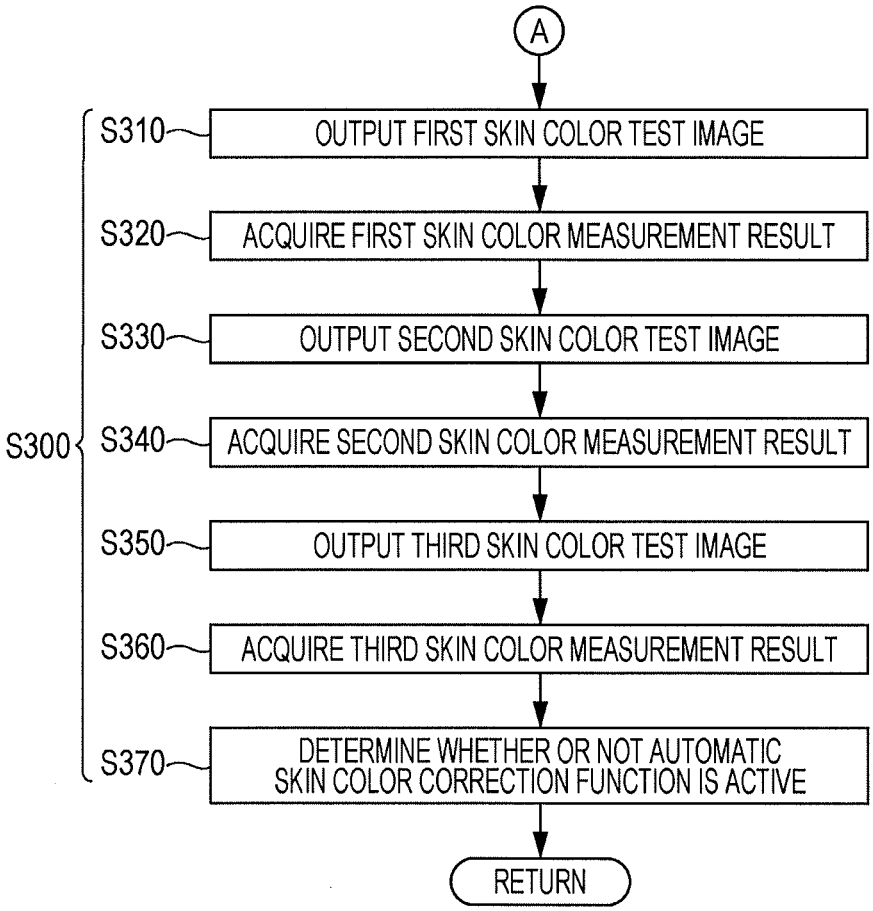

FIGS. 5A and 5B are a flowchart (sub-routine) illustrating a procedure of the automatic correction function test illustrated in step S20 of FIG. 4.

In this process, the computer 20 first executes an automatic luminance correction function test process of testing whether or not an automatic luminance correction function is active on the display 30 (step S100). The automatic luminance correction function automatically corrects the luminance of the display screen 31 in accordance with the contents of the image to be displayed on the display screen 31 of the display 30. Then, the computer 20 executes an automatic halftone correction function test process of testing whether or not an automatic halftone correction function is active on the display 30 (step S200). The automatic halftone correction function automatically corrects the gradation value of halftone on the display screen 31 by automatically adjusting the curve of the gamma value for use in gamma correction in accordance with the contents of the image to be displayed on the display screen 31 of the display 30. Further, the computer 20 executes an automatic skin color correction function test process of testing whether or not an automatic skin color correction function is active on the display 30 (step S300). The automatic skin color correction function automatically corrects the hue of skin color on the display screen 31 by automatically adjusting the gradation value of red (R) displayed on the display screen 31 in accordance with the contents of the image to be displayed on the display screen 31 of the display 30.

As an example of the automatic luminance correction function included in the above-described functions, the display 30 independently performs a correction of reducing the luminance of the entire display image to keep the power consumption at or lower than a predetermined level when the output of the image involves high power consumption. In the automatic luminance correction function, it is assumed that the correction does not take place when a mean gradation value is equal to or greater than a predetermined reference value, and that the correction takes place only when the mean gradation value is smaller than the reference value.

Further, as an example of the automatic halftone correction function, the display 30 independently performs a correction of intentionally increasing or reducing the brightness only in the color of a halftone image (particularly, a gray image having a saturation close to zero) in accordance with the color around the image when the entire image is dark or light. In the automatic halftone correction function, it is assumed that the correction takes place or does not take place depending on an increase or reduction of the mean gradation value.

Further, as a conceivable example of the automatic skin color correction function, the display 30 independently performs a correction of increasing the brightness or improving the complexion only in a skin color portion of an image of a person taken in a dark environment, for example, so as to improve the color of the human skin. In the automatic skin color correction function, it is assumed that the correction does not take place when the mean gradation value is smaller than a predetermined reference value, and that the correction takes place only on pixels close to the skin color when the mean gradation value is equal to or greater than the reference value.

As another conceivable example of the automatic skin color correction function, if a skin color image occupies a large area (number of pixels) of the display screen 31, the display 30 independently performs a correction of recognizing the skin color image as the human skin and increasing the brightness or improving the complexion only in the skin color portion, for example. In such an automatic skin color correction function, it is assumed that the correction takes place only on pixels determined to correspond to the skin color when the number of the pixels or the area determined to correspond to the skin color reaches or exceeds a predetermined value.

Herein, the "skin color image" refers to an image having a color value generally or statistically determined to correspond to the color of the human skin, and is considered to be a chromatic color image including at least a red color component. The color value determined to correspond to the color of the human skin varies depending on the race, the nationality, and the type of the display, and thus the range of the color value varies. The color value determined to correspond to the color of the human skin may be a RGB value (250, 200, 150), for example. In the present exemplary embodiment, the "skin color" will be treated as a "chromatic color including at least a red color component."

Specific description will now be given of the automatic luminance correction function test process illustrated in step S100.

In the automatic luminance correction function test process, the output image data creating unit 220 first creates first luminance test image data on the basis of the original data read from the test image memory 230, and outputs the created first luminance test image data to the display 30 (step S110). Accordingly, the display 30 displays a first luminance test image on the display screen 31 on the basis of the input first luminance test image data. Further, the colorimeter 100 measures the first luminance test image displayed on the display screen 31. Then, the colorimetric data acquiring unit 250 acquires a first luminance measurement result (test colorimetric data) obtained from reading of the first luminance test image by the colorimeter 100 (step S120), and outputs the acquired first luminance measurement result to the automatic correction function determining unit 260.

Then, the output image data creating unit 220 creates second luminance test image data on the basis of the original data read from the test image memory 230, and outputs the created second luminance test image data to the display 30 (step S130). Accordingly, the display 30 displays a second luminance test image on the display screen 31 on the basis of the input second luminance test image data. Further, the colorimeter 100 measures the second luminance test image displayed on the display screen 31. Then, the colorimetric data acquiring unit 250 acquires a second luminance measurement result (test colorimetric data) obtained from reading of the second luminance test image by the colorimeter 100 (step S140), and outputs the acquired second luminance measurement result to the automatic correction function determining unit 260.

Then, the output image data creating unit 220 creates third luminance test image data on the basis of the original data read from the test image memory 230, and outputs the created third luminance test image data to the display 30 (step S150). Accordingly, the display 30 displays a third luminance test image on the display screen 31 on the basis of the input third luminance test image data. Further, the colorimeter 100 measures the third luminance test image displayed on the display screen 31. Then, the colorimetric data acquiring unit 250 acquires a third luminance measurement result (test colorimetric data) obtained from reading of the third luminance test image by the colorimeter 100 (step S160), and outputs the acquired third luminance measurement result to the automatic correction function determining unit 260.

Then, the automatic correction function determining unit 260 determines whether or not the automatic luminance correction function is active on the display 30 on the basis of the first luminance measurement result acquired at step S120, the second luminance measurement result acquired at step S140, and the third luminance measurement result acquired at step S160 (step S170), and outputs a determination result obtained thereby to the display controller 210.

Herein, if the first luminance test image is regarded as a first display image, the second luminance test image or the third luminance test image serves as a second display image. Further, if the second luminance test image is regarded as the first display image, the third luminance test image serves as the second display image. Details of the first luminance test image, the second luminance test image, and the third luminance test image used in the automatic luminance correction function test process in step S100 will be described later.

Subsequently, the automatic halftone correction function test process illustrated in step S200 will be described.

In the automatic halftone correction function test process, the output image data creating unit 220 first creates first halftone test image data on the basis of the original data read from the test image memory 230, and outputs the created first halftone test image data to the display 30 (step S210). Accordingly, the display 30 displays a first halftone test image on the display screen 31 on the basis of the input first halftone test image data. Further, the colorimeter 100 measures the first halftone test image displayed on the display screen 31. Then, the colorimetric data acquiring unit 250 acquires a first halftone measurement result (test colorimetric data) obtained from reading of the first halftone test image by the colorimeter 100 (step S220), and outputs the acquired first halftone measurement result to the automatic correction function determining unit 260.

Then, the output image data creating unit 220 creates second halftone test image data on the basis of the original data read from the test image memory 230, and outputs the created second halftone test image data to the display 30 (step S230). Accordingly, the display 30 displays a second halftone test image on the display screen 31 on the basis of the input second halftone test image data. Further, the colorimeter 100 measures the second halftone test image displayed on the display screen 31. Then, the colorimetric data acquiring unit 250 acquires a second halftone measurement result (test colorimetric data) obtained from reading of the second halftone test image by the colorimeter 100 (step S240), and outputs the acquired second halftone measurement result to the automatic correction function determining unit 260.

Then, the output image data creating unit 220 creates third halftone test image data on the basis of the original data read from the test image memory 230, and outputs the created third halftone test image data to the display 30 (step S250). Accordingly, the display 30 displays a third halftone test image on the display screen 31 on the basis of the input third halftone test image data. Further, the colorimeter 100 measures the third halftone test image displayed on the display screen 31. Then, the colorimetric data acquiring unit 250 acquires a third halftone measurement result (test colorimetric data) obtained from reading of the third halftone test image by the colorimeter 100 (step S260), and outputs the acquired third halftone measurement result to the automatic correction function determining unit 260.

Then, the automatic correction function determining unit 260 determines whether or not the automatic halftone correction function is active on the display 30 on the basis of the first halftone measurement result acquired at step S220, the second halftone measurement result acquired at step S240, and the third halftone measurement result acquired at step S260 (step S270), and outputs a determination result obtained thereby to the display controller 210.

Herein, if the first halftone test image is regarded as the first display image, the second halftone test image or the third halftone test image serves as the second display image. Further, if the second halftone test image is regarded as the first display image, the third halftone test image serves as the second display image. Details of the first halftone test image, the second halftone test image, and the third halftone test image used in the automatic halftone correction function test process in step S200 will be described later.

The automatic skin color correction function test process illustrated in step S300 will now be described.

In the automatic skin color correction function test process, the output image data creating unit 220 first creates first skin color test image data on the basis of the original data read from the test image memory 230, and outputs the created first skin color test image data to the display 30 (step S310). Accordingly, the display 30 displays a first skin color test image on the display screen 31 on the basis of the input first skin color test image data. Further, the colorimeter 100 measures the first skin color test image displayed on the display screen 31. Then, the colorimetric data acquiring unit 250 acquires a first skin color measurement result (test colorimetric data) obtained from reading of the first skin color test image by the colorimeter 100 (step S320), and outputs the acquired first skin color measurement result to the automatic correction function determining unit 260.

Then, the output image data creating unit 220 creates second skin color test image data on the basis of the original data read from the test image memory 230, and outputs the created second skin color test image data to the display 30 (step S330). Accordingly, the display 30 displays a second skin color test image on the display screen 31 on the basis of the input second skin color test image data. Further, the colorimeter 100 measures the second skin color test image displayed on the display screen 31. Then, the colorimetric data acquiring unit 250 acquires a second skin color measurement result (test colorimetric data) obtained from reading of the second skin color test image by the colorimeter 100 (step S340), and outputs the acquired second skin color measurement result to the automatic correction function determining unit 260.

Then, the output image data creating unit 220 creates third skin color test image data on the basis of the original data read from the test image memory 230, and outputs the created third skin color test image data to the display 30 (step S350). Accordingly, the display 30 displays a third skin color test image on the display screen 31 on the basis of the input third skin color test image data. Further, the colorimeter 100 measures the third skin color test image displayed on the display screen 31. Then, the colorimetric data acquiring unit 250 acquires a third skin color measurement result (test colorimetric data) obtained from reading of the third skin color test image by the colorimeter 100 (step S360), and outputs the acquired third skin color measurement result to the automatic correction function determining unit 260.

Then, the automatic correction function determining unit 260 determines whether or not the automatic skin color correction function is active on the display 30 on the basis of the first skin color measurement result acquired at step S320, the second skin color measurement result acquired at step S340, and the third skin color measurement result acquired at step S360 (step S370), and outputs a determination result obtained thereby to the display controller 210.

Herein, if the first skin color test image is regarded as the first display image, the second skin color test image or the third skin color test image serves as the second display image. Further, if the second skin color test image is regarded as the first display image, the third skin color test image serves as the second display image. Details of the first skin color test image, the second skin color test image, and the third skin color test image used in the automatic skin color correction function test process in step S300 will be described later.

Then, if the display controller 210 determines that at least one of the automatic luminance correction function, the automatic halftone correction function, and the automatic skin color correction function described above is active on the display 30, the display controller 210 makes a positive determination (YES) at step S30 illustrated in FIG. 4.

Figure 6:
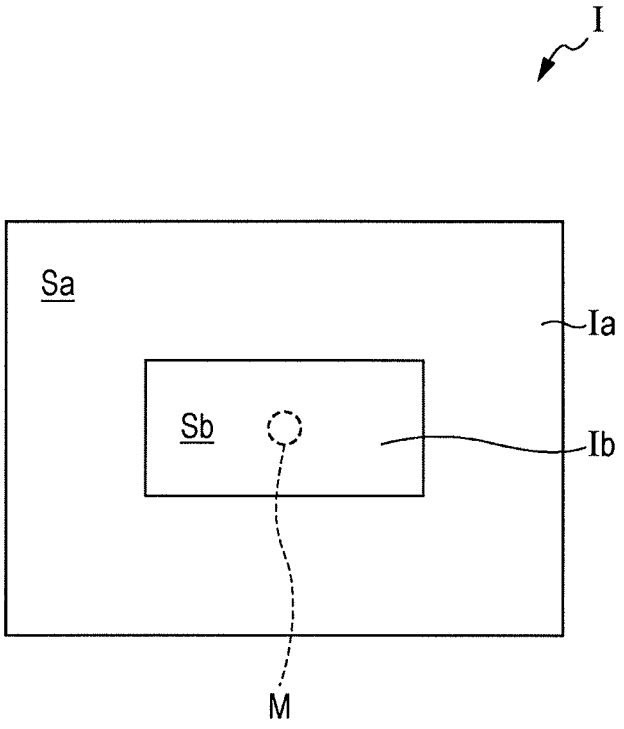
FIG. 6 is a diagram illustrating a configuration example of a test image.

FIG. 6 is a diagram illustrating a configuration example of a test image I displayed on the display screen 31 of the display 30 in the automatic correction function test process illustrated in step S20 of FIG. 4 and FIGS. 5A and 5B. In the present exemplary embodiment, the single test image I is displayed on the entire area of the display screen 31 of the display 30 illustrated in FIG. 1 and so forth.

The test image I of the present exemplary embodiment includes a background image Ia and a foreground image Ib. The background image Ia is formed in a horizontally long rectangular shape in accordance with the size of the display screen 31. The foreground image Ib is similarly formed in a horizontally long rectangular shape, but has an area smaller than the area of the background image Ia, and is disposed to be superimposed on the background image Ia such that the central position of the foreground image Ib matches the central position of the background image Ia. As a result, the foreground image Ib is surrounded by the background image Ia. In the following description, the area of the background image Ia in the test image I will be referred to as the background area Sa, and the area of the foreground image Ib in the test image I will be referred to as the foreground area Sb.

Further, in the present exemplary embodiment, the central position of the test image I, i.e., a central area of the foreground image Ib, is set as a colorimetric area M on the display screen 31 to be measured with the colorimeter 100 illustrated in FIG. 1 and so forth. Therefore, the measurement results acquired at steps S120, S140, S160, S220, S240, S260, S320, S340, and S360 illustrated in FIGS. 5A and 5B are obtained by reading the foreground image Ib in the test image I. In the present exemplary embodiment, therefore, a central portion of the display screen 31 of the display 30 illustrated in FIG. 1 is set as an installation position of the colorimeter 100.

The shape of the foreground image Ib in the test image I is not limited to the rectangular shape, and may be another shape. Further, the position of the foreground image Ib in the test image I is not limited to the center of the background image Ia, and may be another position, if it is possible to set the position as the colorimetric area M to be measured by the colorimeter 100. Also in this case, it is desirable that the foreground image Ib be surrounded by the background image Ia.

Herein, in the present exemplary embodiment, the colorimetric area M in the display area of the foreground image Ib corresponds to a target area, and the sum of the display area of the background image Ia and the display area of the foreground image Ib excluding the colorimetric area M corresponds to a non-target area. In this example, therefore, a portion of the foreground image Ib displayed in the colorimetric area M corresponds to a first image, and the background image Ia and the other portion of the foreground image Ib displayed outside the colorimetric area M correspond to a second image or a third image. Further, in the present exemplary embodiment, the foreground image Ib is displayed in the colorimetric area M, and the same foreground image Ib is also displayed in a peripheral area surrounding the colorimetric area M.

Further, the "mean gradation value" in the present exemplary embodiment is calculated as the mean of the gradation value of the target area and the gradation value of the non-target area. Herein, in the present exemplary embodiment, the non-target area is formed of two images having different gradation values (the background image Ia and the foreground image Ib). In this case, the mean gradation value of the non-target area is calculated on the basis of each of colors (gradation values) displayed in the non-target area and the area ratio of the color. For example, if the ratio of foreground image Ib having (R, G, B) set to (128, 128, 128) to the entire area of the image forming the non-target area is 30%, and the ratio of background image Ia having (R, G, B) set to (64, 64, 64) to the entire area of the image forming the non-target area is 70%, the mean gradation value of the non-target area is (128, 128, 128)×0.3+(64, 64, 64)×0.7≈(83, 83, 83).

FIG. 7 is a diagram for illustrating the contents of the test image I used in the present exemplary embodiment. FIG. 7 illustrates the relationship between a luminance test image I1, a halftone test image I2, and a skin color test image I3 forming the test image I and the background image Ia and the foreground image Ib forming each of the luminance test image I1, the halftone test image I2, and the skin color test image I3. In FIG. 7, each of the background image Ia and the foreground image Ib is associated with an R value representing the size of the red (R) component, a G value representing the size of the green (G) component, a B value representing the size of the blue (B) component, the color expressed by RGB, and the area. In the present exemplary embodiment, each of the RGB colors is expressed in 8 bits, i.e., 256 gradations, and each of the R value, the G value, and the B value may have a numerical value ranging from 0 to 255. Further, each of the R value, the G value, and the B value illustrated in FIG. 7 represents the value (input value) of the test image data as the basis of the test image I.

Figure 8A:
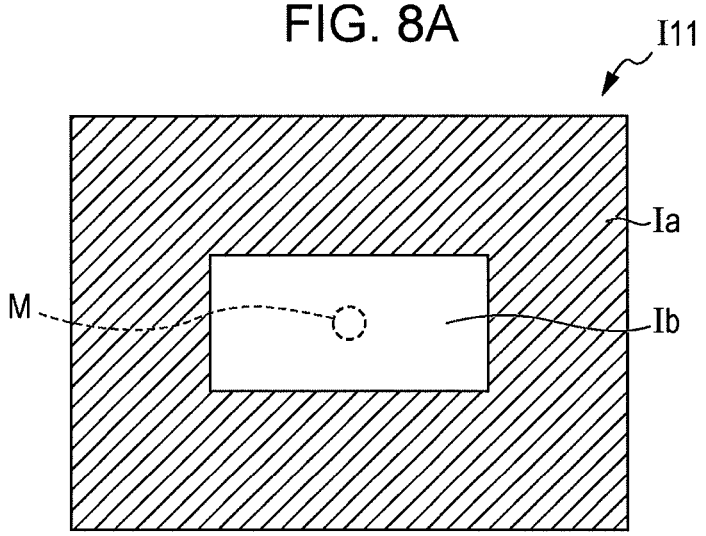
FIGS. 8A to 8C are diagrams for illustrating structures of a luminance test image used in the first exemplary embodiment.
Figure 8B:
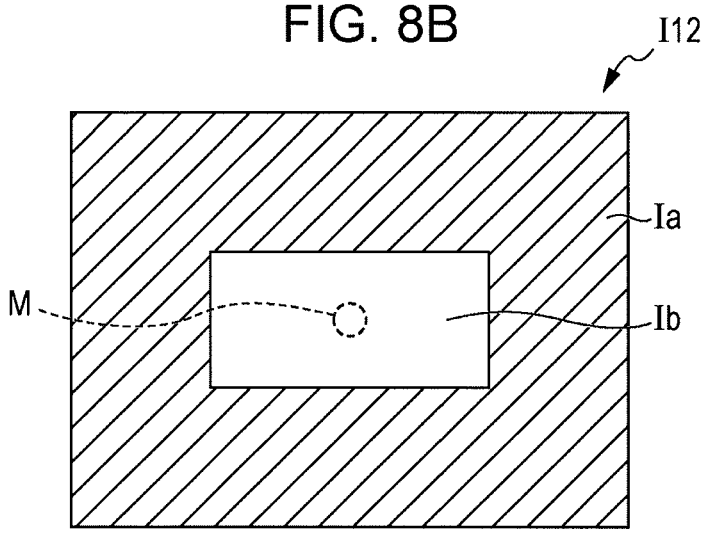
Figure 8C:
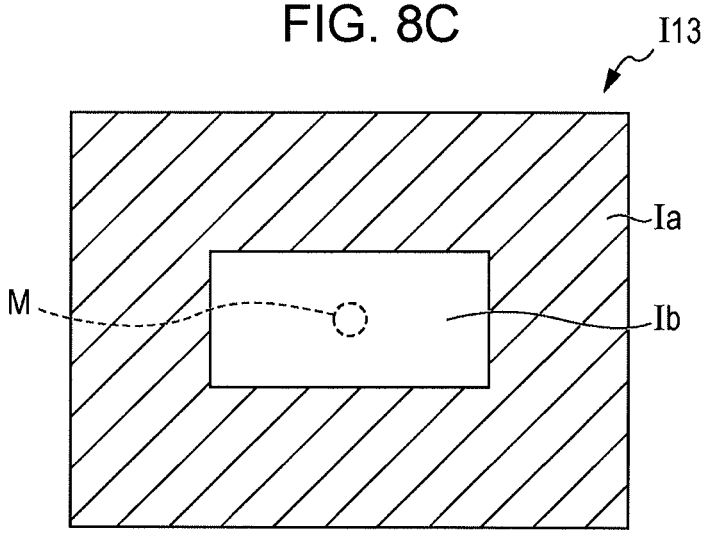

Further, FIGS. 8A to 8C are diagrams for illustrating structures of the luminance test image I1 used in the present exemplary embodiment. In FIGS. 8A to 8C, FIG. 8A illustrates a first luminance test image I11 output and displayed at step S110, FIG. 8B illustrates a second luminance test image I12 output and displayed at step S130, and FIG. 8C illustrates a third luminance test image I13 output and displayed at step S150.

Figure 9A:
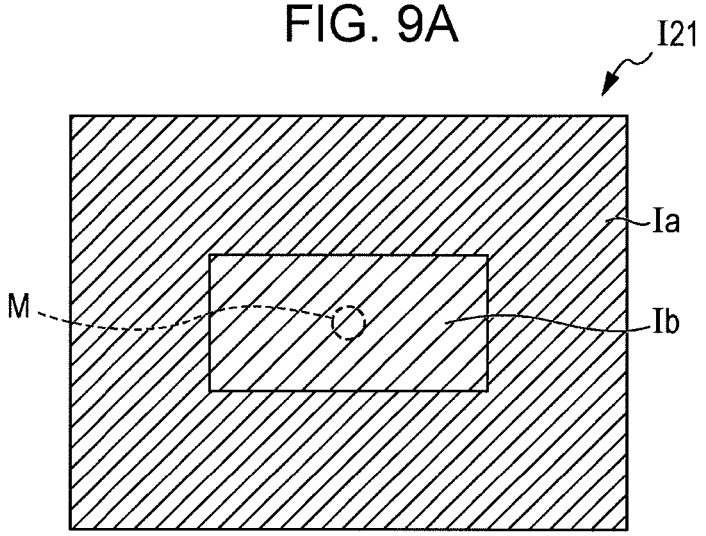
FIGS. 9A to 9C are diagrams for illustrating structures of a halftone test image used in the first exemplary embodiment.
Figure 9B:
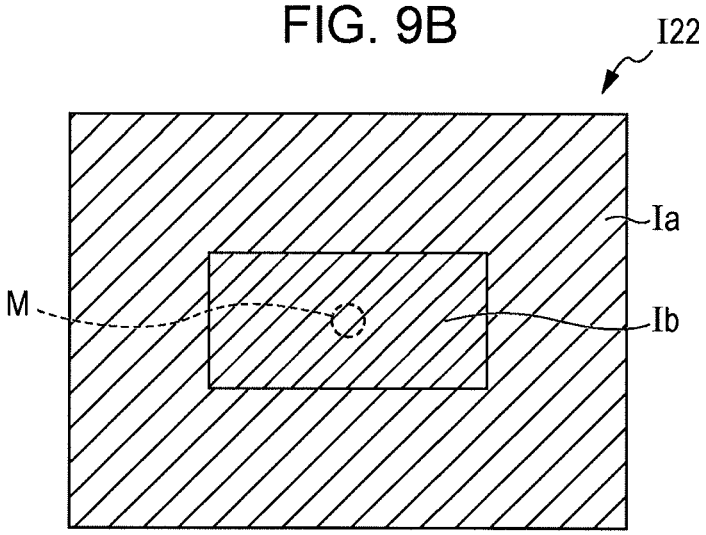
Figure 9C:
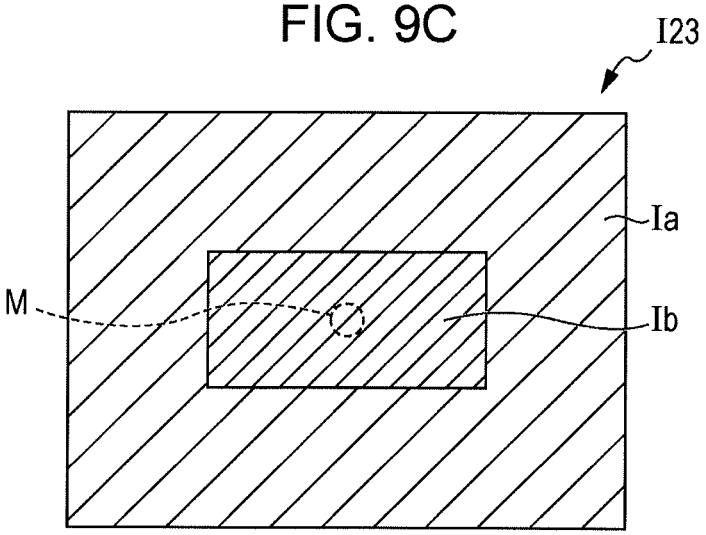

Further, FIGS. 9A to 9C are diagrams for illustrating structures of the halftone test image I2 used in the present exemplary embodiment. In FIGS. 9A to 9C, FIG. 9A illustrates a first halftone test image I21 output and displayed at step S210, FIG. 9B illustrates a second halftone test image I22 output and displayed at step S230, and FIG. 9C illustrates a third halftone test image I23 output and displayed at step S250.

Figure 10A:
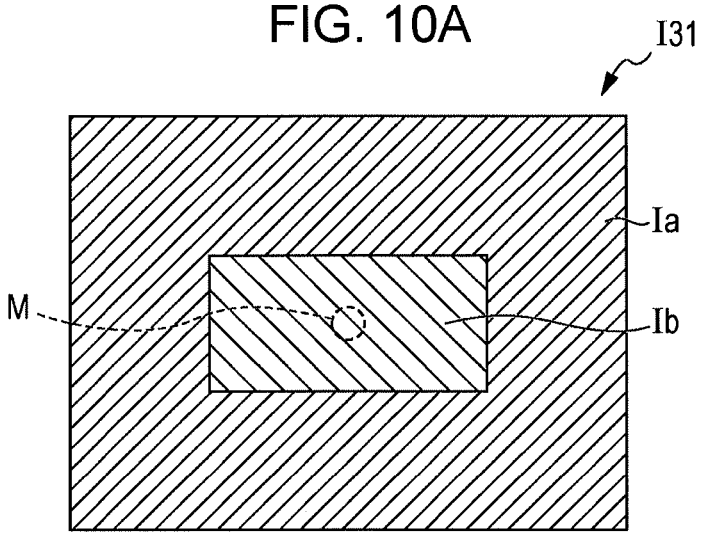
FIGS. 10A to 10C are diagrams for illustrating structures of a skin color test image used in the first exemplary embodiment.
Figure 10B:
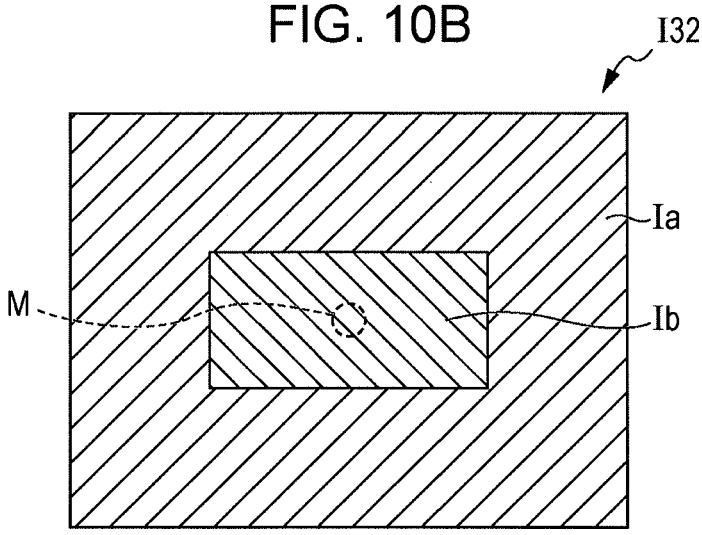
Figure 10C:
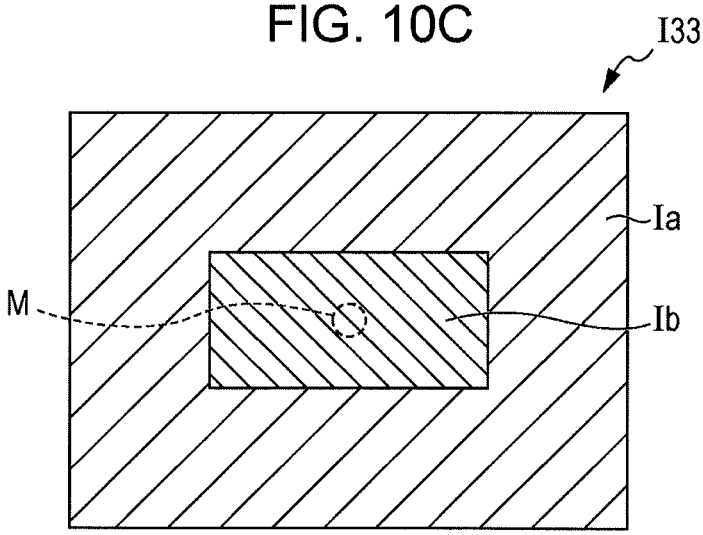

Further, FIGS. 10A to 100 are diagrams for illustrating structures of the skin color test image I3 used in the present exemplary embodiment. In FIGS. 10A to 100, FIG. 10A illustrates a first skin color test image I31 output and displayed at step S310, FIG. 10B illustrates a second skin color test image I32 output and displayed at step S330, and FIG. 100 illustrates a third skin color test image I33 output and displayed at step S350.

With reference to FIG. 7 and FIGS. 8A to 8C, description will first be given of the luminance test image I1 (the first luminance test image I11, the second luminance test image I12, and the third luminance test image I13).

Firstly, the first luminance test image I11 includes the background image Ia having a black color (R, G, B=0, 0, 0) and the background area Sa set to a first background area Sa1 and the foreground image Ib having a white color (R, G, B=255, 255, 255) and the foreground area Sb set to a first foreground area Sb1.

Further, the second luminance test image I12 includes the background image Ia having a dark gray color (R, G, B=64, 64, 64) and the background area Sa set to the first background area Sa1 and the foreground image Ib having the white color (R, G, B=255, 255, 255) and the foreground area Sb set to the first foreground area Sb1.

Further, the third luminance test image I13 includes the background image Ia having a pale gray color (R, G, B=192, 192, 192) and the background area Sa set to the first background area Sa1 and the foreground image Ib having the white color (R, G, B=255, 255, 255) and the foreground area Sb set to the first foreground area Sb1.

As described above, in each of the first luminance test image I11, the second luminance test image I12, and the third luminance test image I13 forming the luminance test image I1, the background area Sa of the background image Ia is maintained constant to the first background area Sa1, and the foreground area Sb of the foreground image Ib is maintained constant to the first foreground area Sb1. Further, in each of the first luminance test image I11, the second luminance test image I12, and the third luminance test image I13, the gradation value of the foreground image Ib is maintained constant to (R, G, B=255, 255, 255). Meanwhile, the gradation value of the background image Ia sequentially changes from (R, G, B=0, 0, 0) in the first luminance test image I11 to (R, G, B=64, 64, 64) in the second luminance test image I12 and then to (R, G, B=192, 192, 192) in the third luminance test image I13.

When the respective means of the gradation values (mean gradation values) of the first luminance test image I11, the second luminance test image I12, and the third luminance test image I13 are compared with one another, therefore, the mean gradation value of the second luminance test image I12 is greater than the mean gradation value of the first luminance test image I11, and the mean gradation value of the third luminance test image I13 is greater than the mean gradation value of the second luminance test image I12.

With reference to FIG. 7 and FIGS. 9A to 9C, description will now be given of the halftone test image I2 (the first halftone test image I21, the second halftone test image I22, and the third halftone test image I23).

Firstly, the first halftone test image I21 includes the background image Ia having the black color (R, G, B=0, 0, 0) and the background area Sa set to the first background area Sa1 and the foreground image Ib having a medium gray color (R, G, B=128, 128, 128) between the dark gray color and the pale gray color and the foreground area Sb set to the first foreground area Sb1.

Further, the second halftone test image I22 includes the background image Ia having the dark gray color (R, G, B=64, 64, 64) and the background area Sa set to the first background area Sa1 and the foreground image Ib having the medium gray color (R, G, B=128, 128, 128) and the foreground area Sb set to the first foreground area Sb1.

Further, the third halftone test image I23 includes the background image Ia having the pale gray color (R, G, B=192, 192, 192) and the background area Sa set to the first background area Sa1 and the foreground image Ib having the medium gray color (R, G, B=128, 128, 128) and the foreground area Sb set to the first foreground area Sb1.

As described above, in each of the first halftone test image I21, the second halftone test image I22, and the third halftone test image I23 forming the halftone test image I2, the background area Sa of the background image Ia is maintained constant to the first background area Sa1, and the foreground area Sb of the foreground image Ib is maintained constant to the first foreground area Sb1. Further, in each of the first halftone test image I21, the second halftone test image I22, and the third halftone test image I23, the gradation value of the foreground image Ib is maintained constant to (R, G, B=128, 128, 128). Meanwhile, the gradation value of the background image Ia sequentially changes from (R, G, B=0, 0, 0) in the first halftone test image I21 to (R, G, B=64, 64, 64) in the second halftone test image I22 and then to (R, G, B=192, 192, 192) in the third halftone test image I23.

When the respective mean gradation values of the first halftone test image I21, the second halftone test image I22, and the third halftone test image I23 are compared with one another, therefore, the mean gradation value of the second halftone test image I22 is greater than the mean gradation value of the first halftone test image I21, and the mean gradation value of the third halftone test image I23 is greater than the mean gradation value of the second halftone test image I22.

With reference to FIG. 7 and FIGS. 10A to 10C, description will finally be given of the skin color test image I3 (the first skin color test image I31, the second skin color test image I32, and the third skin color test image I33).

Firstly, the first skin color test image I31 includes the background image Ia having the black color (R, G, B=0, 0, 0) and the background area Sa set to the first background area Sa1 and the foreground image Ib having a medium red color (R, G, B=128, 0, 0) and the foreground area Sb set to the first foreground area Sb1.

Further, the second skin color test image I32 includes the background image Ia having the dark gray color (R, G, B=64, 64, 64) and the background area Sa set to the first background area Sa1 and the foreground image Ib having the medium red color (R, G, B=128, 0, 0) and the foreground area Sb set to the first foreground area Sb1.

Further, the third skin color test image I33 includes the background image Ia having the pale gray color (R, G, B=192, 192, 192) and the background area Sa set to the first background area Sa1 and the foreground image Ib having the medium red color (R, G, B=128, 0, 0) and the foreground area Sb set to the first foreground area Sb1.

As described above, in each of the first skin color test image I31, the second skin color test image I32, and the third skin color test image I33 forming the skin color test image I3, the background area Sa of the background image Ia is maintained constant to the first background area Sa1, and the foreground area Sb of the foreground image Ib is maintained constant to the first foreground area Sb1. Further, in each of the first skin color test image I31, the second skin color test image I32, and the third skin color test image I33, the gradation value of the foreground image Ib is maintained constant to (R, G, B=128, 0, 0). Meanwhile, the gradation value of the background image Ia sequentially changes from (R, G, B=0, 0, 0) in the first skin color test image I31 to (R, G, B=64, 64, 64) in the second skin color test image I32 and then to (R, G, B=192, 192, 192) in the third skin color test image I33.

When the respective mean gradation values of the first skin color test image I31, the second skin color test image I32, and the third skin color test image I33 are compared with one another, therefore, the mean gradation value of the second skin color test image I32 is greater than the mean gradation value of the first skin color test image I31, and the mean gradation value of the third skin color test image I33 is greater than the mean gradation value of the second skin color test image I32.

Herein, the red color (medium red color) is used in the foreground image Ib forming each of the first skin color test image I31, the second skin color test image I32, and the third skin color test image I33 of the skin color test image I3, since red (R) is dominant over green (G) and blue (B) in the skin color expressed by three colors of RGB.

Figure 11A:
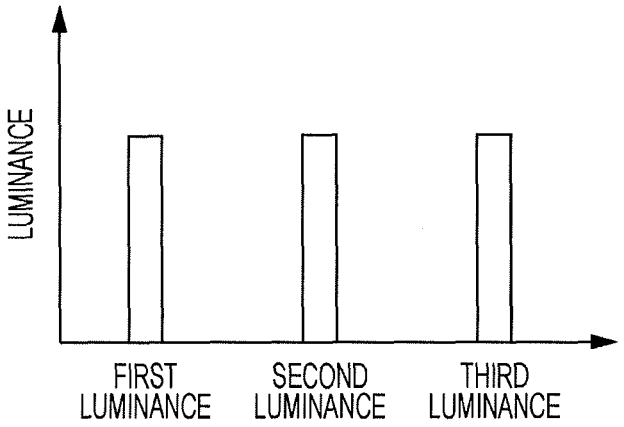
FIGS. 11A to 11C are diagrams for illustrating a method of determining whether or not an automatic luminance correction function is active.
Figure 11B:
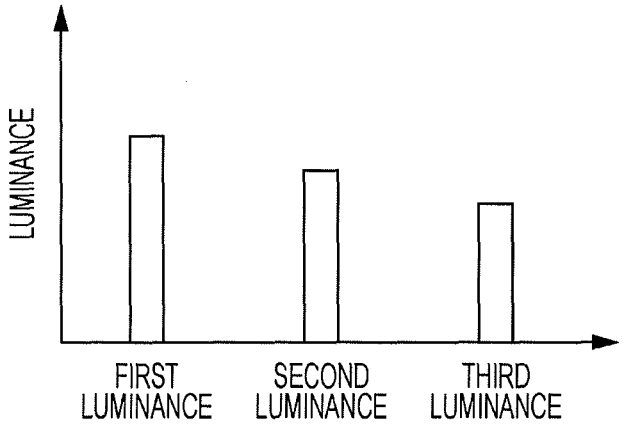
Figure 11C:
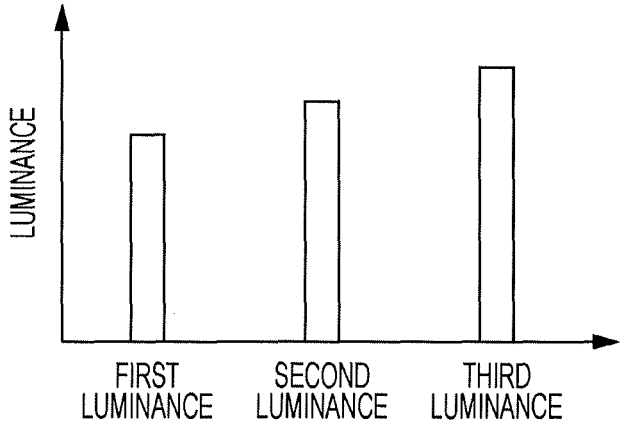

FIGS. 11A to 11C are diagrams for illustrating a method of determining whether or not the automatic luminance correction function is active, which is illustrated in step S170 of FIG. 5A. In each of FIGS. 11A to 11C, the horizontal axis represents the first luminance measurement result acquired at step S120 (described as "first luminance"), the second luminance measurement result acquired at step S140 (described as "second luminance"), and the third luminance measurement result acquired at step S160 (described as "third luminance"), and the vertical axis represents the luminance (an L* component in the L*a*b* color space) obtained from of each of the measurement results. Therefore, the first luminance corresponds to the reading result of the foreground image Ib (the colorimetric area M) in the first luminance test image I11 illustrated in FIG. 8A, and the second luminance corresponds to the reading result of the foreground image Ib (the colorimetric area M) in the second luminance test image I12 illustrated in FIG. 8B. Further, the third luminance corresponds to the reading result of the foreground image Ib (the colorimetric area M) in the third luminance test image I13 illustrated in FIG. 8C.

The example illustrated in FIG. 11A will first be described.

In the example illustrated in FIG. 11A, the first luminance, the second luminance, and the third luminance are substantially the same in value. This indicates that the luminance of the foreground image Ib is maintained substantially constant irrespective of the mean gradation value of the luminance test image I1 displayed on the display screen 31. If such a result is obtained, therefore, it is possible to determine that the automatic luminance correction function is not active on the display 30 as a test object.

The example illustrated in FIG. 11B will now be described.

In the example illustrated in FIG. 11B, the second luminance is smaller in value than the first luminance, and the third luminance is smaller in value than the second luminance. This indicates that the luminance of the foreground image Ib is reduced in accordance with an increase of the mean gradation value of the luminance test image I1 displayed on the display screen 31. If such a result is obtained, therefore, it is possible to determine that the automatic luminance correction function is active on the display 30 as the test object. Such a tendency of the first luminance to the third luminance indicates that the display 30 is performing an automatic luminance correction intended to reduce the power consumption of the display 30 by reducing the luminance of the entire display screen 31 in accordance with an increase in brightness of the image displayed on the display screen 31.

Finally, the example illustrated in FIG. 11C will be described.

In the example illustrated in FIG. 11C, the second luminance is greater in value than the first luminance, and the third luminance is greater in value than the second luminance. This indicates that the luminance of the foreground image Ib is increased in accordance with an increase of the mean gradation value of the luminance test image I1 displayed on the display screen 31. Also when such a result is obtained, therefore, it is possible to determine that the automatic luminance correction function is active on the display 30 as the test object. Such a tendency of the first luminance to the third luminance indicates that the display 30 is performing an automatic luminance correction intended to improve the contrast (modulation) of the image displayed on the display screen 31 by increasing the luminance of the entire display screen 31 in accordance with the increase in brightness of the image displayed on the display screen 31.

Although detailed description will be omitted here, also in the determination of whether or not the automatic halftone correction function is active and the determination of whether or not the automatic skin color correction function is active, which are illustrated in step S270 of FIG. 5A and step S370 of FIG. 5B, respectively, it is possible to compare three values of luminance (the first luminance, the second luminance, and the third luminance) obtained from three measurement results and determine whether or not the automatic halftone correction is being performed or whether or not the automatic skin color correction is being performed from the tendency obtained from the comparison, similarly as in the above-described determination of whether or not the automatic luminance correction function is active.

Second Exemplary Embodiment

The present exemplary embodiment is substantially the same in basic configuration as the first exemplary embodiment, but is different from the first exemplary embodiment in the relationship between the background image Ia and the foreground image Ib in the test image I displayed on the display screen 31 of the display 30. In the present exemplary embodiment, components similar to those of the first exemplary embodiment will be designated by the same reference numerals, and detailed description thereof will be omitted.

FIG. 12 is a diagram for illustrating the contents of the test image I used in the present exemplary embodiment. FIG. 12 illustrates the relationship between the luminance test image I1, the halftone test image I2, and the skin color test image I3 forming the test image I and the background image Ia and the foreground image Ib forming each of the luminance test image I1, the halftone test image I2, and the skin color test image I3. In FIG. 12, each of the background image Ia and the foreground image Ib is associated with the R value representing the size of the red (R) component, the G value representing the size of the green (G) component, the B value representing the size of the blue (B) component, the color expressed by RGB, and the area.

Figure 13A:
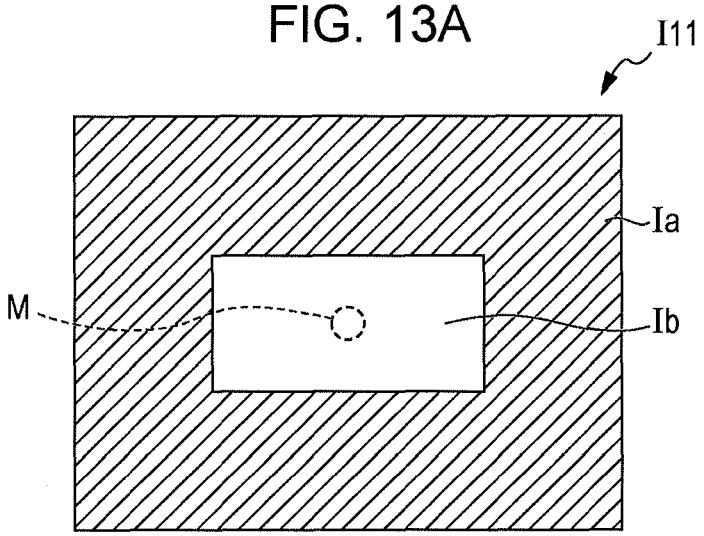
FIGS. 13A to 13C are diagrams for illustrating structures of a luminance test image used in the second exemplary embodiment.
Figure 13B:
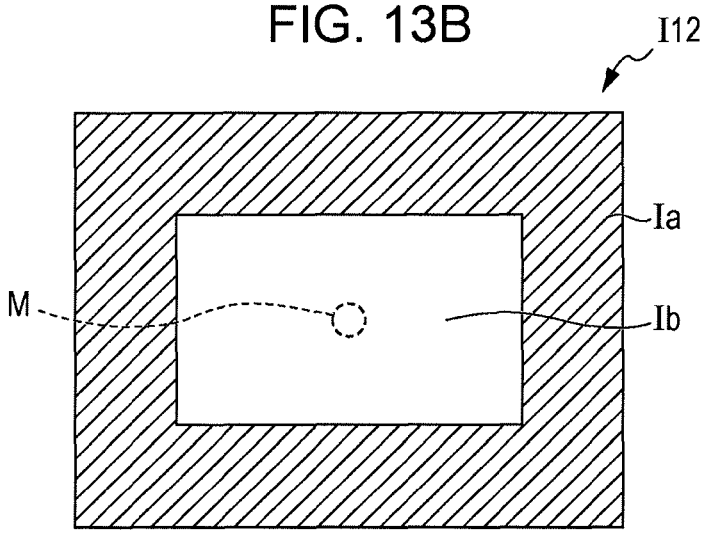
Figure 13C:
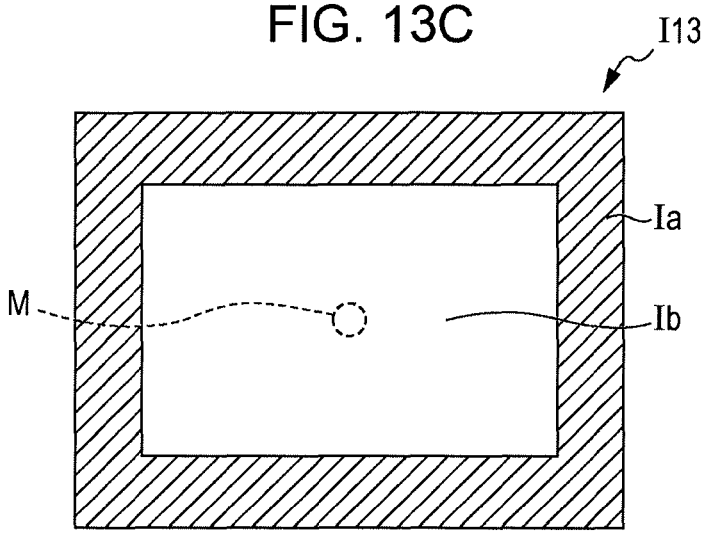

Further, FIGS. 13A to 13C are diagrams for illustrating structures of the luminance test image I1 used in the present exemplary embodiment. In FIGS. 13A to 13C, FIG. 13A illustrates the first luminance test image I11 output and displayed at step S110, FIG. 13B illustrates the second luminance test image I12 output and displayed at step S130, and FIG. 13C illustrates the third luminance test image I13 output and displayed at step S150.

Figure 14A:
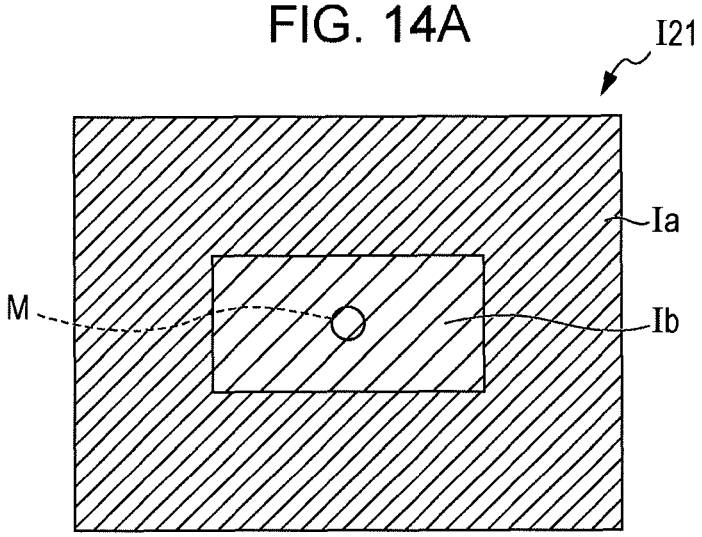
FIGS. 14A to 14C are diagrams for illustrating structures of a halftone test image used in the second exemplary embodiment.
Figure 14B:
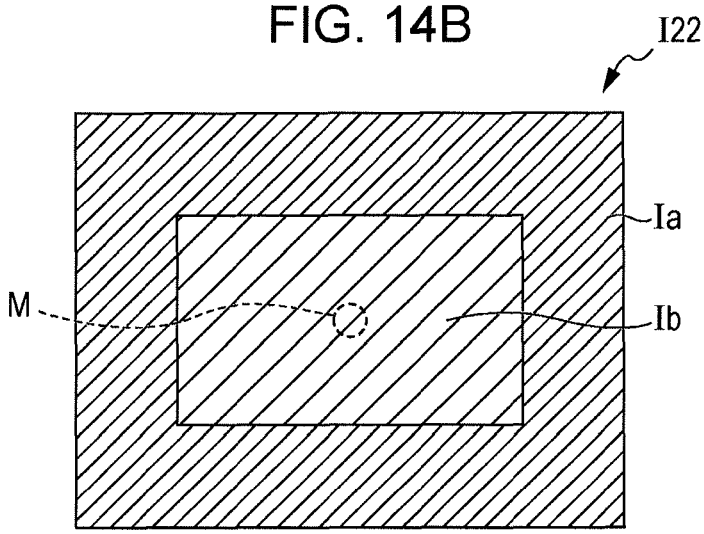
Figure 14C:
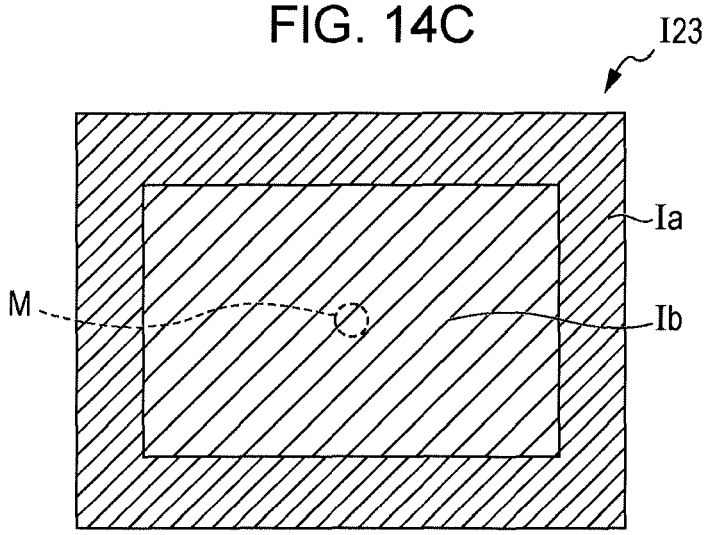

Further, FIGS. 14A to 14C are diagrams for illustrating structures of the halftone test image I2 used in the present exemplary embodiment. In FIGS. 14A to 14C, FIG. 14A illustrates the first halftone test image I21 output and displayed at step S210, FIG. 14B illustrates the second halftone test image I22 output and displayed at step S230, and FIG. 14C illustrates the third halftone test image I23 output and displayed at step S250.

Figure 15A:
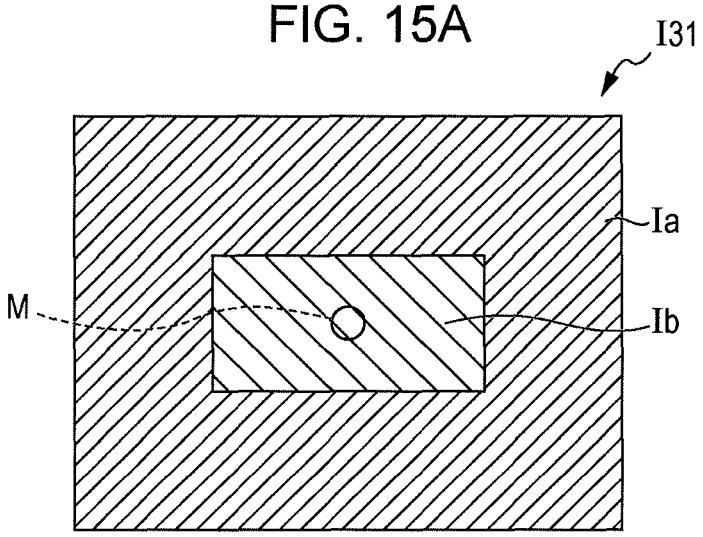
FIGS. 15A to 15C are diagrams for illustrating structures of a skin color test image used in the second exemplary embodiment.
Figure 15B:
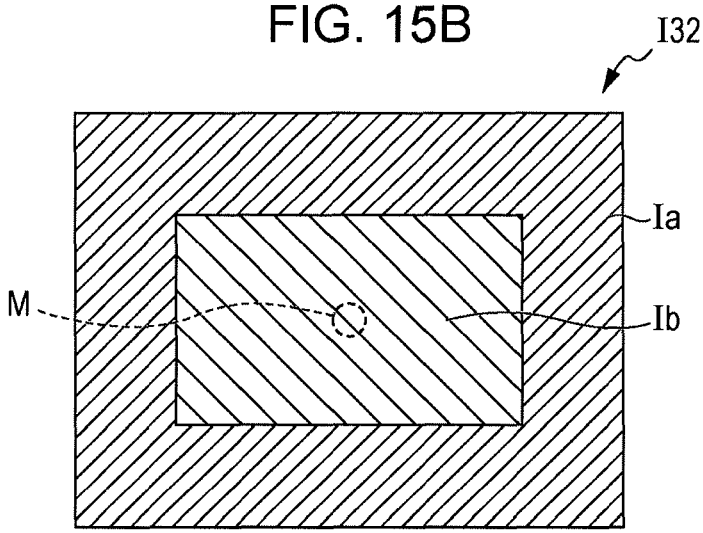
Figure 15C:
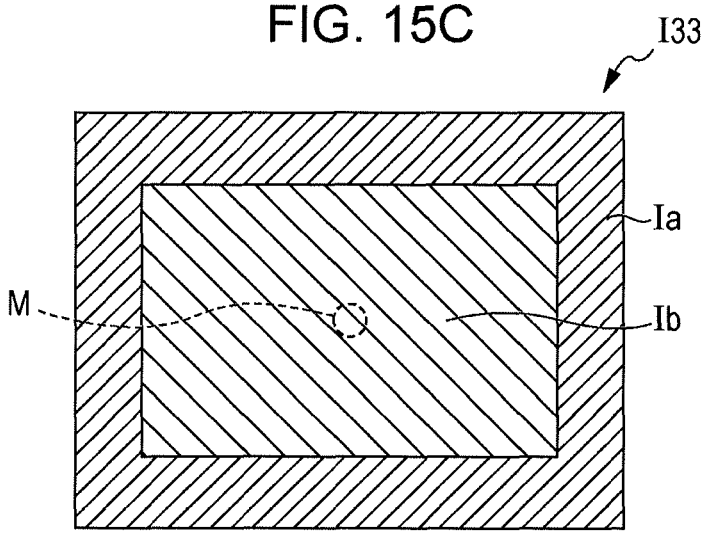

Furthermore, FIGS. 15A to 15C are diagrams for illustrating structures of the skin color test image I3 used in the present exemplary embodiment. In FIGS. 15A to 15C, FIG. 15A illustrates the first skin color test image I31 output and displayed at step S310, FIG. 15B illustrates the second skin color test image I32 output and displayed at step S330, and FIG. 15C illustrates the third skin color test image I33 output and displayed at step S350.

With reference to FIG. 12 and FIGS. 13A to 13C, description will first be given of the luminance test image I1 (the first luminance test image I11, the second luminance test image I12, and the third luminance test image I13).

Firstly, the first luminance test image I11 includes the background image Ia having the black color (R, G, B=0, 0, 0) and the background area Sa set to the first background area Sa1 and the foreground image Ib having the white color (R, G, B=255, 255, 255) and the foreground area Sb set to the first foreground area Sb1.

Further, the second luminance test image I12 includes the background image Ia having the black color (R, G, B=0, 0, 0) and the background area Sa set to a second background area Sa2 (<Sa1) and the foreground image Ib having the white color (R, G, B=255, 255, 255) and the foreground area Sb set to a second foreground area Sb2 (>Sb1).

Further, the third luminance test image I13 includes the background image Ia having the black color (R, G, B=0, 0, 0) and the background area Sa set to a third background area Sa3 (<Sa2) and the foreground image Ib having the white color (R, G, B=255, 255, 255) and the foreground area Sb set to a third foreground area Sb3 (>Sb2).

As described above, in each of the first luminance test image I11, the second luminance test image I12, and the third luminance test image I13 forming the luminance test image I1, the gradation value of the background image Ia is maintained constant to (R, G, B=0, 0, 0), and the gradation value of the foreground image Ib is maintained constant to (R, G, B=255, 255, 255). Meanwhile, the background area Sa of the background image Ia sequentially changes from the first background area Sa1 in the first luminance test image I11 to the second background area Sa2 in the second luminance test image I12 and then to the third background area Sa3 in the third luminance test image I13 (Sa1>Sa2>Sa3). Further, the foreground area Sb of the foreground image Ib sequentially changes from the first foreground area Sb1 in the first luminance test image I11 to the second foreground area Sb2 in the second luminance test image I12 and then to the third foreground area Sb3 in the third luminance test image I13 (Sb1<Sb2<Sb3).

When the respective means of the gradation values (mean gradation values) of the first luminance test image I11, the second luminance test image I12, and the third luminance test image I13 are compared with one another, therefore, the mean gradation value of the second luminance test image I12 is greater than the mean gradation value of the first luminance test image I11, and the mean gradation value of the third luminance test image I13 is greater than the mean gradation value of the second luminance test image I12.

With reference to FIG. 12 and FIGS. 14A to 14C, description will now be given of the halftone test image I2 (the first halftone test image I21, the second halftone test image I22, and the third halftone test image I23).

Firstly, the first halftone test image I21 includes the background image Ia having the black color (R, G, B=0, 0, 0) and the background area Sa set to the first background area Sa1 and the foreground image Ib having the medium gray color (R, G, B=128, 128, 128) and the foreground area Sb set to the first foreground area Sb1.

Further, the second halftone test image I22 includes the background image Ia having the black color (R, G, B=0, 0, 0) and the background area Sa set to the second background area Sa2 (<Sa1) and the foreground image Ib having the medium gray color (R, G, B=128, 128, 128) and the foreground area Sb set to the second foreground area Sb2 (>Sb1).

Further, the third halftone test image I23 includes the background image Ia having the black color (R, G, B=0, 0, 0) and the background area Sa set to the third background area Sa3 (<Sa2) and the foreground image Ib having the medium gray color (R, G, B=128, 128, 128) and the foreground area Sb set to the third foreground area Sb3 (>Sb2).

As described above, in each of the first halftone test image I21, the second halftone test image I22, and the third halftone test image I23 forming the halftone test image I2, the gradation value of the background image Ia is maintained constant to (R, G, B=0, 0, 0), and the gradation value of the foreground image Ib is maintained constant to (R, G, B=128, 128, 128). Meanwhile, the background area Sa of the background image Ia sequentially changes from the first background area Sa1 in the first halftone test image I21 to the second background area Sa2 in the second halftone test image I22 and then to the third background area Sa3 in the third halftone test image I23 (Sa1>Sa2>Sa3). Further, the foreground area Sb of the foreground image Ib sequentially changes from the first foreground area Sb1 in the first halftone test image I21 to the second foreground area Sb2 in the second halftone test image I22 and then to the third foreground area Sb3 in the third halftone test image I23 (Sb1<Sb2<Sb3).

When the respective mean gradation values of the first halftone test image I21, the second halftone test image I22, and the third halftone test image I23 are compared with one another, therefore, the mean gradation value of the second halftone test image I22 is greater than the mean gradation value of the first halftone test image I21, and the mean gradation value of the third halftone test image I23 is greater than the mean gradation value of the second halftone test image I22.

With reference to FIG. 12 and FIGS. 15A to 15C, description will finally be given of the skin color test image I3 (the first skin color test image I31, the second skin color test image I32, and the third skin color test image I33).

Firstly, the first skin color test image I31 includes the background image Ia having the black color (R, G, B=0, 0, 0) and the background area Sa set to the first background area Sa1 and the foreground image Ib having the medium red color (R, G, B=128, 0, 0) and the foreground area Sb set to the first foreground area Sb1.

Further, the second skin color test image I32 includes the background image Ia having the black color (R, G, B=0, 0, 0) and the background area Sa set to the second background area Sa2 (<Sa1) and the foreground image Ib having the medium red color (R, G, B=128, 0, 0) and the foreground area Sb set to the second foreground area Sb2 (>Sb1).

Further, the third skin color test image I33 includes the background image Ia having the black color (R, G, B=0, 0, 0) and the background area Sa set to the third background area Sa3 (<Sa2) and the foreground image Ib having the medium red color (R, G, B=128, 0, 0) and the foreground area Sb set to the third foreground area Sb3 (>Sb2).

As described above, in each of the first skin color test image I31, the second skin color test image I32, and the third skin color test image I33 forming the skin color test image I3, the gradation value of the background image Ia is maintained constant to (R, G, B=0, 0, 0), and the gradation value of the foreground image Ib is maintained constant to (R, G, B=128, 0, 0). Meanwhile, the background area Sa of the background image Ia sequentially changes from the first background area Sa1 in the first skin color test image I31 to the second background area Sa2 in the second skin color test image I32 and then to the third background area Sa3 in the third skin color test image I33 (Sa1>Sa2>Sa3). Further, the foreground area Sb of the foreground image Ib sequentially changes from the first foreground area Sb1 in the first skin color test image I31 to the second foreground area Sb2 in the second skin color test image I32 and then to the third foreground area Sb3 in the third skin color test image I33 (Sb1<Sb2<Sb3).

When the respective mean gradation values of the first skin color test image I31, the second skin color test image I32, and the third skin color test image I33 are compared with one another, therefore, the mean gradation value of the second skin color test image I32 is greater than the mean gradation value of the first skin color test image I31, and the mean gradation value of the third skin color test image I33 is greater than the mean gradation value of the second skin color test image I32.

Also in the present exemplary embodiment, it is possible to determine whether or not the automatic luminance correction is being performed, whether or not the automatic halftone correction is being performed, and whether or not the automatic skin color correction is being performed by using the same method as the method of the first exemplary embodiment.

In the first and second exemplary embodiments, the test is conducted on all of the automatic luminance correction function, the automatic halftone correction function, and the automatic skin color correction function. However, the test is not limited thereto, and may be conducted on at least one of these functions.

Further, in the first and second exemplary embodiments, the minimum gradation value (R, G, B=0, 0, 0) or the maximum gradation value (R, G, B=255, 255, 255) is used in some cases in the background image Ia or the foreground image Ib used in the test image I. However, the gradation value is not limited thereto, and may be a low gradation value other than the minimum gradation value or a high gradation value other than the maximum gradation value.

Further, in the present exemplary embodiment, three types of the test image I are used in each of the automatic luminance correction function test, the automatic halftone correction function test, and the automatic skin color correction function test. However, at least two types of the test image I are sufficient. To grasp the tendency of the correction functions, however, it is desirable to use three or more types of the test image I.

Further, in the present exemplary embodiment, the automatic skin color correction function has been described as an example of the automatic correction function for correcting a chromatic color. However, another chromatic color may be corrected. In that case, the color of the foreground image Ib in the test image I may be green (G) or blue (B).

Third Exemplary Embodiment

In the first and second exemplary embodiments, the computer 20 determines whether or not the automatic correction function is set on the basis of the result (test colorimetric data) obtained from reading by the colorimeter 100 of the test image I displayed on the display screen 31 of the display 30. Meanwhile, the present exemplary embodiment is configured to allow the determination of whether or not the automatic correction function is set on the basis of the result of visual checking by an operator of the test image I displayed on the display screen 31 of the display 30. In the present exemplary embodiment, components similar to those of the first and second exemplary embodiments will be designated by the same reference numerals, and detailed description thereof will be omitted.

Figure 16:
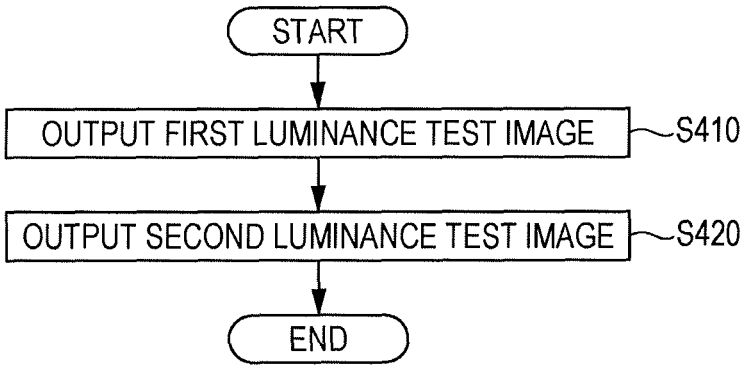
FIG. 16 is a flowchart illustrating a procedure of a process of displaying a test image in a third exemplary embodiment.

FIG. 16 is a flowchart illustrating a procedure of a process of displaying the test image I in the present exemplary embodiment. The process is executed by the computer 20 as an example of an image data output device.

In this process, the output image data creating unit 220 creates the first luminance test image data on the basis of the original data read from the test image memory 230, and outputs the created first test image data to the display 30 (step S410). Accordingly, the display 30 displays the first luminance test image I11 on the display screen 31 on the basis of the input first luminance test image data. Then, the operator visually checks the first luminance test image I11 displayed on the display screen 31.

Then, the output image data creating unit 220 creates the second luminance test image data on the basis of the original data read from the test image memory 230, and outputs the created second luminance test image data to the display 30 (step S420). Accordingly, the display 30 displays the second luminance test image I12 on the display screen 31 on the basis of the input second luminance test image data. Then, the operator visually checks the second luminance test image I12 displayed on the display screen 31.

Figure 17:
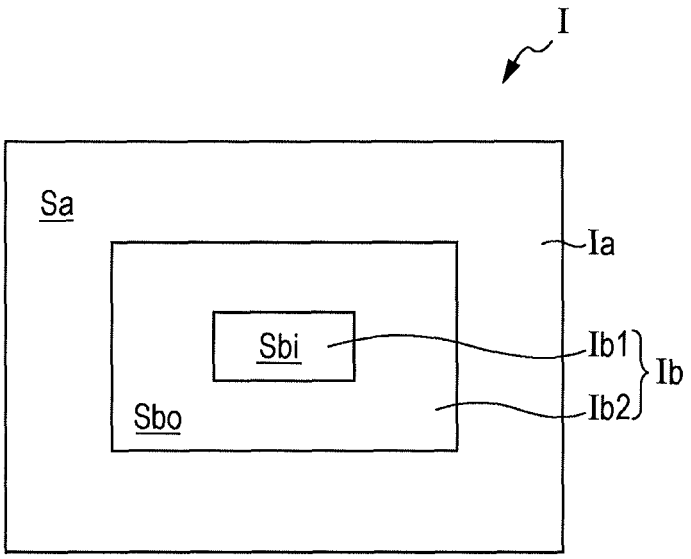
FIG. 17 is a diagram illustrating a configuration example of the test image in the third exemplary embodiment.

FIG. 17 is a diagram illustrating a configuration example of the test image I displayed on the display screen 31 of the display 30. Also in the present exemplary embodiment, the single test image I is displayed on the entire area of the display screen 31 of the display 30 illustrated in FIG. 1 and so forth.

The test image I of the present exemplary embodiment includes the background image Ia and the foreground image Ib. The background image Ia is formed in a horizontally long rectangular shape in accordance with the size of the display screen 31. The foreground image Ib is similarly formed in a horizontally long rectangular shape, but has an area smaller than the area of the background image Ia, and is disposed to be superimposed on the background image Ia such that the central position of the foreground image Ib matches the central position of the background image Ia. Further, the foreground image Ib of the present exemplary embodiment includes a first foreground image Ib1 and a second foreground image Ib2. The first foreground image Ib1 is formed in a horizontally long rectangular shape. The second foreground image Ib2 is similarly formed in a horizontally long rectangular shape, but has an area larger than the area of the first foreground image Ib1, and is disposed such that the central position of the second foreground image Ib2 matches the central position of the first foreground image Ib1. As a result, the foreground image Ib is surrounded by the background image Ia, and the first foreground image Ib1 is surrounded by the second foreground image Ib2 in the foreground image Ib. In the following description, the area of the first foreground image Ib1 in the foreground image Ib will be referred to as the inner foreground area Sbi, and the area of the second foreground image Ib2 in the foreground image Ib will be referred to as the outer foreground area Sbo.

FIG. 18 is a diagram for illustrating the contents of the test image I (more specifically, the luminance test image I1) used in the present exemplary embodiment. FIG. 18 illustrates the relationship between the first luminance test image I11 and the second luminance test image I12 forming the luminance test image I1 and the background image Ia and the foreground image Ib (the first foreground image Ib1 and the second foreground image Ib2) forming each of the first luminance test image I11 and the second luminance test image I12. In FIG. 18, each of the background image Ia and the foreground image Ib is associated with the R value representing the size of the red (R) component, the G value representing the size of the green (G) component, the B value representing the size of the blue (B) component, the color expressed by RGB, and the area.

Figure 19A:
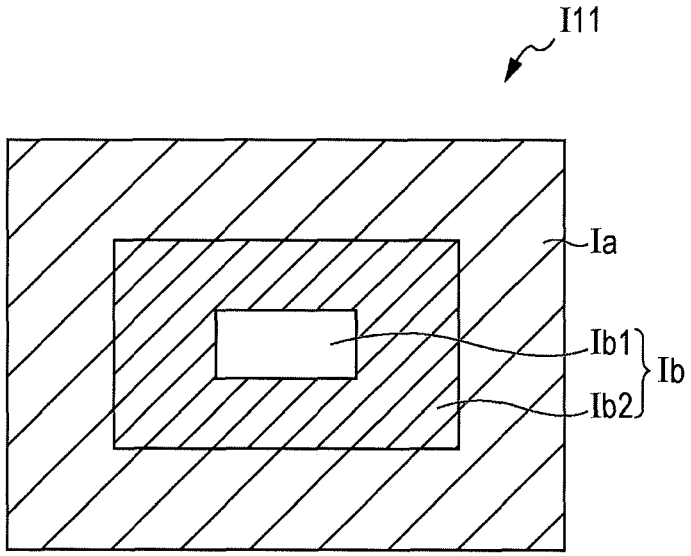
FIGS. 19A and 19B are diagrams for illustrating structures of a luminance test image in the third exemplary embodiment.
Figure 19B:
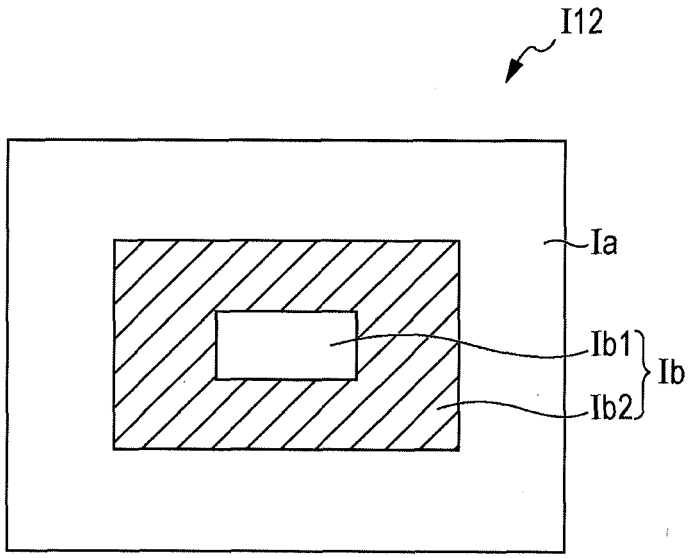

Further, FIGS. 19A and 19B are diagrams for illustrating structures of the luminance test image I1 used in the present exemplary embodiment. In FIGS. 19A and 19B, FIG. 19A illustrates the first luminance test image I11 output and displayed at step S410, and FIG. 19B illustrates the second luminance test image I12 output and displayed at step S420.

With reference to FIG. 18 and FIGS. 19A and 19B, description will now be given of the luminance test image I1 (the first luminance test image I11 and the second luminance test image I12).

Firstly, the first luminance test image I11 includes the background image Ia having the dark gray color (R, G, B=64, 64, 64) and the background area Sa set to a fourth background area Sa4, the first foreground image Ib1 having the white color (R, G, B=255, 255, 255) and the inner foreground area Sbi set to a fourth foreground area Sb4, and the second foreground image Ib2 having the black color (R, G, B=0, 0, 0) and the outer foreground area Sbo set to a fifth foreground area Sb5.

Further, the second luminance test image I12 includes the background image Ia having the pale gray color (R, G, B=192, 192, 192) and the background area Sa set to the fourth background area Sa4, the first foreground image Ib1 having the white color (R, G, B=255, 255, 255) and the inner foreground area Sbi set to the fourth foreground area Sb4, and the second foreground image Ib2 having the black color (R, G, B=0, 0, 0) and the outer foreground area Sbo set to the fifth foreground area Sb5.

As described above, in each of the first luminance test image I11 and the second luminance test image I12 forming the luminance test image I1, the background area Sa of the background image Ia is maintained constant to the fourth background area Sa4. Further, the inner foreground area Sbi of the first foreground image Ib1 is maintained constant to the fourth foreground area Sb4, and the outer foreground area Sbo of the second foreground image Ib2 is maintained constant to the fifth foreground area Sb5. Further, in each of the first luminance test image I11 and the second luminance test image I12, the gradation value of the first foreground image Ib1 is maintained constant to (R, G, B=255, 255, 255), and the gradation value of the second foreground image Ib2 is maintained constant to (R, G, B=0, 0, 0). Meanwhile, the gradation value of the background image Ia sequentially changes from (R, G, B=64, 64, 64) in the first luminance test image I11 to (R, G, B=192, 192, 192) in the second luminance test image I12.

When the respective means of the gradation values (mean gradation values) of the first luminance test image I11 and the second luminance test image I12 are compared with each other, therefore, the mean gradation value of the second luminance test image I12 is greater than the mean gradation value of the first luminance test image I11.

Herein, a case will be considered in which the above-described luminance test image I1 (the first luminance test image I11 and the second luminance test image I12) is displayed on the display screen 31 with the use of the display 30.

If the automatic luminance correction function is not active on the display 30, a visually recognizable level of change in brightness of the first foreground image Ib1 is unlikely to occur between the first luminance test image I11 displayed on the display screen 31 and the second luminance test image I12 displayed on the display screen 31. Meanwhile, if the automatic luminance correction function is active on the display 30, a visually recognizable level of change in brightness of the first foreground image Ib1 is likely to occur between the first luminance test image I11 displayed on the display screen 31 and the second luminance test image I12 displayed on the display screen 31. In this case, the second foreground image Ib2 set to the minimum gradation value (R, G, B=0, 0, 0) is disposed around the first foreground image Ib1 set to the maximum gradation value (R, G, B=255, 255, 255). Therefore, the difference in brightness between the first foreground image Ib1 in the first luminance test image I11 and the first foreground image Ib1 in the second luminance test image I12 is easily noticeable.

With the use of the test image I as in the present exemplary embodiment, therefore, it is possible to determine whether or not the automatic luminance correction function is active on the display 30 on the basis of the result of visual check by the operator, without using the colorimeter 100.

The computer 20 of the first exemplary embodiment may be understood as an automatic correction function determining apparatus including an output unit and a determining unit. The output unit outputs image data to a display. In the image data, a target area serving as a colorimetric target is fixed in color, and a background area not serving as a colorimetric target is changed in color. The determining unit determines whether or not an automatic correction function is set in the display on the basis of a colorimetric result of the target area in a display image displayed by the display on the basis of the image data.

The computer 20 of the first exemplary embodiment may also be understood as an automatic correction function determining apparatus including a creating unit and a determining unit. The creating unit creates first image data and second image data. The first image data includes a first area set to a first color and a second area set to a second color. The second image data includes a third area set to the first color and the same size as the size of the first area and a fourth area set to a third color and the same size as the size of the second area. On the basis of a measurement result of the color of the first area in a first image displayed on a display screen of a display on the basis of the first image data and a measurement result of the color of the third area in a second image displayed on the display screen of the display on the basis of the second image data, the determining unit determines whether or not an automatic correction function is set in the display.

Further, the computer 20 of the second exemplary embodiment may be understood as an automatic correction function determining apparatus including an output unit and a determining unit. The output unit outputs image data to a display. In the image data, a target area serving as a colorimetric target and a background area not serving as a colorimetric target are fixed in color, and an area ratio between the target area and the background area is changed. The determining unit determines whether or not an automatic correction function is set in the display on the basis of a colorimetric result of the target area in a display image displayed by the display on the basis of the image data.

Furthermore, the computer 20 of the second exemplary embodiment may be understood as an automatic correction function determining apparatus including a creating unit and a determining unit. The creating unit creates first image data and second image data. The first image data includes a first area set to a first color and a second area set to a second color. The second image data includes a third area set to the first color and a size larger than the size of the first area and a fourth area set to the second color and a size smaller than the size of the second area. On the basis of a measurement result of the color of the first area in a first image displayed on a display screen of a display on the basis of the first image data and a measurement result of the color of the third area in a second image displayed on the display screen of the display on the basis of the second image data, the determining unit determines whether or not an automatic correction function is set in the display.

The foregoing description of the exemplary embodiments of the present invention has been provided for the purposes of illustration and description. It is not intended to be exhaustive or to limit the invention to the precise forms disclosed. Obviously, many modifications and variations will be apparent to practitioners skilled in the art. The embodiments were chosen and described in order to best explain the principles of the invention and its practical applications, thereby enabling others skilled in the art to understand the invention for various embodiments and with the various modifications as are suited to the particular use contemplated. It is intended that the scope of the invention be defined by the following claims and their equivalents.

What is claimed is:

1. An automatic correction function determining apparatus comprising:

an output unit that sequentially outputs a first display image and a second display image to a display, the first display image including a target area serving as a colorimetric target and including a first image and a non-target area not serving as a colorimetric target and including a second image, and the second display image including a target area including the first image and a non-target area including a third image different in mean gradation value from the second image; and a determining unit that determines that an automatic correction function is active on the display, if a colorimetric result obtained from colorimetric measurement of the target area in the first display image displayed on the display is different from a colorimetric result obtained from colorimetric measurement of the target area in the second display image displayed on the display, and determines that an automatic correction function is not active on the display if the colorimetric result obtained from colorimetric measurement of the target area in the first display image displayed on the display is the same as the colorimetric result obtained from colorimetric measurement of the target area in the second display image displayed on the display.

2. The automatic correction function determining apparatus according to claim 1, wherein the output unit forms an area surrounding and near the target area with the first image in each of the first display image and the second display image.

3. The automatic correction function determining apparatus according to claim 2, wherein the first image has a skin color, and wherein at least a part of each of the second image and the third image includes a skin color area, and the skin color area of the third image is larger than the skin color area of the second image.

4. The automatic correction function determining apparatus according to claim 1, wherein the first image has a skin color, and wherein at least a part of each of the second image and the third image includes a skin color area, and the skin color area of the third image is larger than the skin color area of the second image.

5. The automatic correction function determining apparatus according to claim 1, wherein, when it is determined that an automatic correction function is active, a notification unit notifies a user that the automatic correction function is active by providing a message on the display.

6. The automatic correction function determining apparatus according to claim 5, wherein, after the notification, the apparatus awaits user input regarding whether to turn the automatic correction function off.

7. A non-transitory computer readable medium storing a program causing a computer to execute a process for determining whether or not an automatic correction function is active, the process comprising:

sequentially outputting a first display image and a second display image to a display, the first display image including a target area serving as a colorimetric target and including a first image and a non-target area not serving as a colorimetric target and including a second image, and the second display image including the target area including the first image and the non-target area including a third image different in mean gradation value from the second image; and determining that the automatic correction function is active on the display, if a colorimetric result obtained from colorimetric measurement of the target area in the first display image displayed on the display is different from a colorimetric result obtained from colorimetric measurement of the target area in the second display image displayed on the display, and determining that an automatic correction function is not active on the display if the colorimetric result obtained from colorimetric measurement of the target area in the first display image displayed on the display is the same as the colorimetric result obtained from colorimetric measurement of the target area in the second display image displayed on the display.

8. An automatic correction function determining method comprising:

sequentially outputting a first display image and a second display image to a display, the first display image including a target area serving as a colorimetric target and formed including a first image and a non-target area not serving as a colorimetric target and including a second image, and the second display image including the target area including the first image and the non-target area including a third image different in mean gradation value from the second image; and determining that an automatic correction function is active on the display, if a colorimetric result obtained from colorimetric measurement of the target area in the first display image displayed on the display is different from a colorimetric result obtained from colorimetric measurement of the target area in the second display image displayed on the display, and determining that an automatic correction function is not active on the display if the colorimetric result obtained from colorimetric measurement of the target area in the first colorimetric measurement of the target area in the second display image displayed on the display.

* * * * *